US007258510B2

(12) United States Patent
Kawasaki

(10) Patent No.: US 7,258,510 B2
(45) Date of Patent: Aug. 21, 2007

(54) SYSTEMS AND METHODS USEFUL IN STABILIZING PLATFORMS AND VESSELS HAVING PLATFORMS AND LEGS

(76) Inventor: Masasuke Kawasaki, 1002 Michigan Ave., Slidell, LA (US) 70458

( * ) Notice: Subject to any disclaimer, the term of this patent is extended or adjusted under 35 U.S.C. 154(b) by 0 days.

(21) Appl. No.: 09/823,909

(22) Filed: Mar. 29, 2001

(65) Prior Publication Data

US 2002/0182014 A1 Dec. 5, 2002

(51) Int. Cl.
*B63B 35/44* (2006.01)

(52) U.S. Cl. ..... 405/198; 405/196

(58) Field of Classification Search ..... 114/44, 114/48, 264, 265; 405/3, 4, 7, 218–219, 405/221, 196–200, 202–205, 207–208, 223.1, 405/224, 227, 226

See application file for complete search history.

(56) References Cited

U.S. PATENT DOCUMENTS

| | | | | |
|---|---|---|---|---|
| 2,612,024 A | * | 9/1952 | Hunsucker | 405/222 |
| 2,612,025 A | * | 9/1952 | Hunsucker | 405/209 |
| 2,892,314 A | * | 6/1959 | Hornsby et al. | 405/196 |
| 3,093,972 A | * | 6/1963 | Ward, Jr. | 405/198 |
| 3,568,621 A | | 3/1971 | Kawasaki | 114/235 |

(Continued)

FOREIGN PATENT DOCUMENTS

GB 2175257 * 11/1986

OTHER PUBLICATIONS

"Allowable Stress for Compression Members of 36 KSI Specified Yield Stress Steel," Table 3-36 and "Chapter C—Frames and other structures," 5-134-5-135, from *AICS Manual of Steel Construction*, Eighth Edition, c1980.

(Continued)

*Primary Examiner*—Sunil Singh
(74) *Attorney, Agent, or Firm*—Fulbright & Jaworski L.L.P.

(57) ABSTRACT

Disclosed is a system useful in stabilizing a vessel. The vessel includes, but is not limited to, a first leg, a second leg, a third leg, and a platform coupled to the first, second, and third legs. The system can include a first brace coupled to the first leg at a first location along the first brace. The first brace can form an acute angle with the first leg. The system can also include an anchoring structure coupled to the first brace at a second location along the first brace. The first and second locations along the first brace can define a first brace length between them. At least a portion of the first brace length can be located beneath the platform. Also disclosed is a system useful in stabilizing a vessel, where the vessel includes, but is not limited to, a first leg having an upper end and a lower end, a second leg having an upper end and a lower end, a third leg having an upper end and a lower end, and a platform coupled to the first, second, and third legs. The system can include a first footing structure coupled to the lower end of the first leg, and a brace coupled to the first footing structure. Also disclosed is a method useful in stabilizing a vessel that has, but is not limited to, a platform and three or more legs coupled to the platform such that platform may be raised or lowered along the legs.

18 Claims, 28 Drawing Sheets

U.S. PATENT DOCUMENTS

| | | | | | |
|---|---|---|---|---|---|
| 3,681,928 | A | * | 8/1972 | Vincken et al. | 405/196 |
| 3,697,048 | A | * | 10/1972 | Sarno | 187/242 |
| 3,850,397 | A | * | 11/1974 | Kutchai | 254/98 |
| 4,063,426 | A | * | 12/1977 | Hansen | 405/205 |
| 4,270,877 | A | * | 6/1981 | Post | 405/198 |
| 4,293,239 | A | * | 10/1981 | Petty et al. | 405/203 |
| 4,326,479 | A | | 4/1982 | Kawasaki | 114/248 |
| 4,329,088 | A | | 5/1982 | Lucas | 405/196 |
| 4,349,297 | A | * | 9/1982 | Misener | 405/221 |
| 4,378,178 | A | * | 3/1983 | Roach | 405/224 |
| 4,388,024 | A | * | 6/1983 | Dysarz | 405/198 |
| 4,407,214 | A | | 10/1983 | Kawasaki | 114/249 |
| 4,492,270 | A | * | 1/1985 | Horton | 166/358 |
| 4,575,975 | A | * | 3/1986 | Eisenberg | 52/109 |
| 4,662,787 | A | * | 5/1987 | Tatsuguchi | 405/198 |
| 4,813,815 | A | * | 3/1989 | McGehee | 405/202 |
| 4,936,710 | A | * | 6/1990 | Petty et al. | 405/224 |
| 5,165,357 | A | | 11/1992 | Kawasaki | 114/248 |
| 5,224,798 | A | * | 7/1993 | Thomas | 405/198 |
| 5,385,432 | A | * | 1/1995 | Kiyomiya et al. | 405/204 |
| 5,390,618 | A | * | 2/1995 | Wolff et al. | 114/230.23 |
| 5,687,668 | A | | 11/1997 | Kawasaki | 114/249 |
| 6,461,081 | B2 | * | 10/2002 | Legleux | 405/199 |

OTHER PUBLICATIONS

Page 38 from *Offshore Engineering*, Aug. 2000.

Breusers, "Special Projects—Figures 5(A&B), 6, 7, and 8," x,12-x,15, *Symposium on Offshore Hydrodynamics*, Aug. 25-26, 1991.

Page from "Two liftboats for cardinal services, a subsidiary of superior energy services," *Bollinger Notice*, 2000.

Figures of Class 130, 100, 60, and 180 Self-Elevating Vessels (6 pages). *Blue Streak Industries Inc. Publication*.

Spotts, "Gears," In: *Mechanical Design Analysis*, Chapter 10:172-173, 1964.

Vendrell, "The catenary," In: *The Oil Rig Mooring Handbook*, 19-21, 1977.

* cited by examiner

SYSTEMS AND METHODS USEFUL IN STABILIZING PLATFORMS AND VESSELS HAVING PLATFORMS AND LEGS

BACKGROUND OF THE INVENTION

1. Field of the Invention

The present invention relates to systems and methods useful for stabilizing platforms and vessels having platforms, which vessels include self-elevating vessels such as liftboats and stationary drilling platforms. More particularly, the present invention relates to systems and methods that include braces adapted to be coupled to one or more legs of a vessel, such as a liftboat. The present invention also relates to methods and systems useful in stabilizing the platforms on such vessels. The use of the present systems with traditional vessels creates the present vessels.

2. Description of Related Art

Vessels having platforms that may be raised or lowered along three or more legs have been used in the marine industry for many years as mobile service centers for offshore oil and gas production platforms. These vessels are known by different names depending on, for example, the size of the platform, the size of the cargo supported by the platform, and/or the length of the legs. Some such designations include "liftboats" and "jack-up boats." In addition, stationary vessels known as "jack-up platforms" include the same type of platform and leg arrangement that liftboats and jack-up boats have.

With the exception of jack-up platforms, these vessels are generally self-propelled, meaning that they do not require a tug or a barge to advance them through a body of water. These vessels are also self-elevating, meaning that once the vessel has reached its designation, the platform—which is referred to by some as a barge—may be raised or lowered along the length of the legs using, for example, a hydraulic driving, or jacking, mechanism that may include a combination of racks and pinions. In operation, these vessels may be propelled toward their destination under their own power, or by the power of others, such as tugs or barges. Once the vessel is in place, the legs, which during transit were raised sufficiently off the ocean floor to avoid getting caught on anything sticking up from the ocean floor, are driven downwardly until they have firmly contacted the floor. Next, and using the same driving mechanisms that caused the legs to descend, the platform is raised along the legs to a desired height, and work may begin. These legs may be made of tubular steel, the diameters of which generally increase with increases in length (i.e., longer legs are generally greater in diameter than shorter legs). The legs may also be made of truss-type structures. A figure depicting a traditional liftboat is illustrated in FIG. 1 (liftboat peripherals, such as deck cargo and the like, are not depicted).

In addition to their usefulness as the mobile service stations described above, these vessels are useful for practically any type of work that requires a portable base in a marine environment. Cranes, cameras, crews, and cargoes of any kind may be transported, loaded, and unloaded off of the stable platforms these vessels provide. Their uses are virtually unlimited.

The forces to which the legs of these vessels are normally subject are numerous and potentially damaging. For example, the vertical loads that are applied to the legs by virtue of the weight of the platform and the various deck cargoes can cause the legs to buckle. Furthermore, the legs may be bent by the horizontal forces that result from the wind and waves. Additionally, when floating in transit, the raised legs can make the vessel top-heavy and, as a result, capsize. If the weather is inclement when the vessel is floating, the legs may also be damaged by whipping due to rolling or pitching.

As mentioned above, and in an effort to address one or more of these problems, some legs are made of truss-type structures. However, design and proportional constraints have limited the dimensions of the triangular sections of these structures, rendering them ineffective for adequately addressing these problems. Furthermore, increasing the diameters of tubular legs has not proven to be an adequate way of addressing the foregoing problems due to the same types of design and proportional constraints.

Traditional anchors have also been utilized in an attempt to address the problems associated with the forces to which the legs of traditional vessels are normally subject. In this regard, it is known in the art to drop multiple anchors connected to the platform of traditional vessels at predetermined locations with a body of water in an attempt to stabilize the position of the vessel. This may be done by arranging multiple anchors (usually 3, 4, or more) connected to chains or the like in a manner that allows the vessel to come symmetrically to rest between them. However, such use of anchors suffers from various problems, including, for example, the tendency of the anchor to shift in surroundings defined by mud, or other soft or loose material.

The problems pointed out with the foregoing leg designs are not intended to be exhaustive but rather are among many that tend to impair the effectiveness of previously known legs. Other noteworthy problems may also exist; however, those presented above should be sufficient to demonstrate that previous techniques appearing in the art have not been altogether satisfactory, particularly in achieving a vessel with a stable set of legs.

SUMMARY OF THE INVENTION

In one respect, the invention is a system useful in stabilizing a vessel. The vessel includes a first leg, a second leg, a third leg, and a platform coupled to the first, second, and third legs. The system includes a first brace coupled to the first leg at a first location along the first brace. The first brace forms an acute angle with the first leg. The system also includes an anchoring structure coupled to the first brace at a second location along the first brace. The first and second locations along the first brace define a first brace length between them. At least a portion of the first brace length is located beneath the platform.

The first brace may be coupled to the first leg through a first footing structure located between the first brace and the first leg. In this embodiment, the first footing structure is coupled to one end of the first leg.

The first leg may have at least one opening near the end to which the footing structure is coupled, and the system may include a pin having an axis. In this embodiment, the pin is positioned within the opening such that the first leg may rotate about the axis.

The first footing structure may include one or more protrusions defining space into which material from a floor beneath a body of water collects when the footing structure contacts the floor. The first brace may be coupled to the second leg at a third location along the first brace. The anchoring structure may include a winch. The anchoring structure may include the platform. One or more racks may be secured to the first leg, and the anchoring structure may include a holding rack configured to engage one of the one or more racks.

One or more racks may be secured to the first leg, and the first anchoring structure may include a ring coupled to the platform. In this embodiment, the ring has a holding rack configured to engage one of the one or more racks.

The first brace may be rigid. The first brace may be flexible. The first brace may include multiple loops that are linked together, or wire rope.

The system may include a second brace coupled to the first leg at a first location along the second brace. In this embodiment, the second brace forms an acute angle with the first leg. In this embodiment, the system may also include an anchoring structure coupled to the second brace at a second location along the second brace. In this embodiment, the first and second locations along the second brace define a second brace length between them, and at least a portion of the second brace length is located beneath the platform.

The anchoring structures coupled to the first and second braces may be the same anchoring structure.

The system may include a third brace coupled to the first leg at a first location along the third brace. In this embodiment, the third brace forms an acute angle with the first leg. In this embodiment, the system may also include an anchoring structure coupled to the third brace at a second location along the third brace. In this embodiment, the first and second locations along the third brace define a third brace length between them, and at least a portion of the third brace length is located beneath the platform.

The anchoring structures coupled to the first, second, and third braces may be the same anchoring structure.

The system may include a second brace coupled to the second leg at a first location along the second brace. In this embodiment, the second brace forms an acute angle with the second leg. In this embodiment, the system may also include an anchoring structure coupled to the second brace at a second location along the second brace. In this embodiment, the first and second locations along the second brace define a second brace length between them, and at least a portion of the second brace length is located beneath the platform.

The second brace may be coupled to the second leg through a second footing structure located between the second brace and the second leg. In this embodiment, the second footing structure is coupled to one end of the second leg.

The system may include a third brace coupled to the second leg at a first location along the third brace. In this embodiment, the third brace forms an acute angle with the second leg. In this embodiment, the system may also include an anchoring structure coupled to the third brace at a second location along the third brace. In this embodiment, the first and second locations along the third brace defining a third brace length between them, and at least a portion of the third brace length is located beneath the platform.

The anchoring structures coupled to the second and third braces may be the same anchoring structure.

The system may include a fourth brace coupled to the second leg at a first location along the fourth brace. In this embodiment, the fourth brace forms an acute angle with the second leg. In this embodiment, the system may also include an anchoring structure coupled to the fourth brace at a second location along the fourth brace. In this embodiment, the first and second locations along the fourth brace define a fourth brace length between them, and at least a portion of the fourth brace length is located beneath the platform.

The system may include a third brace coupled to the third leg at a first location along the third brace. In this embodiment, the third brace forms an acute angle with the third leg. In this embodiment, the system may also include an anchoring structure coupled to the third brace at a second location along the third brace. In this embodiment, the first and second locations along the third brace define a third brace length between them, and at least a portion of the third brace length is located beneath the platform.

The third brace may be coupled to the third leg through a third footing structure located between the third brace and the third leg. In this embodiment, the third footing structure is coupled to one end of the third leg.

The system may include a fourth brace coupled to the third leg at a first location along the fourth brace. In this embodiment, the fourth brace forms an acute angle with the third leg. In this embodiment, the system may also include an anchoring structure coupled to the fourth brace at a second location along the fourth brace. In this embodiment, the first and second locations along the fourth brace define a fourth brace length between them, and at least a portion of the fourth brace length is located beneath the platform.

The anchoring structures coupled to the third and fourth braces may be the same anchoring structures.

The system may include a fifth brace coupled to the third leg at a first location along the fifth brace. In this embodiment, the fifth brace forms an acute angle with the third leg. In this embodiment, the system may also include an anchoring structure coupled to the fifth brace at a second location along the fifth brace. In this embodiment, the first and second locations along the fifth brace define a fifth brace length between them, and at least a portion of the fifth brace length is located beneath the platform.

The vessel may have a fourth leg, and the system may include a fourth brace coupled to the fourth leg at a first location along the fourth brace. In this embodiment, the fourth brace forms an acute angle with the fourth leg. In this embodiment, the system may also include an anchoring structure coupled to the fourth brace at a second location along the fourth brace. In this embodiment, the first and second locations along the fourth brace define a fourth brace length between them, and at least a portion of the fourth brace length is located beneath the platform.

The vessel may have a fifth leg, and the system may also include a fifth brace coupled to the fifth leg at a first location along the fifth brace. In this embodiment, the fifth brace forms an acute angle with the fifth leg. In this embodiment, the system may also include an anchoring structure coupled to the fifth brace at a second location along the fifth brace. In this embodiment, the first and second locations along the fifth brace define a fifth brace length between them, and at least a portion of the fifth brace length is located beneath the platform.

The vessel may have a sixth leg, and the system may include a sixth brace coupled to the sixth leg at a first location along the sixth brace. In this embodiment, the sixth brace forms an acute angle with the sixth leg. In this embodiment, the system may also include an anchoring structure coupled to the sixth brace at a second location along the sixth brace. In this embodiment, the first and second locations along the sixth brace define a sixth brace length between them, and at least a portion of the sixth brace length is located beneath the platform.

In another respect, the invention is a system useful in stabilizing a vessel. The vessel includes a first leg having an upper end and a lower end, a second leg having an upper end and a lower end, a third leg having an upper end and a lower end, and a platform coupled to the first, second, and third legs. The system includes a first footing structure coupled to the lower end of the first leg, and a brace coupled to the first footing structure.

The system may include the brace being coupled to the upper end of the first leg. The system may include the brace being coupled to a winch secured to the platform. The brace may be flexible. The brace may be rigid. One or more racks may be secured to the first leg, and the system may include a holding rack configured to engage one of the one or more racks.

One or more racks may be secured to the first leg, and the system may include a ring coupled to the platform. In this embodiment, the ring has a holding rack configured to engage one of the one or more racks.

The system may include a second brace coupled to the first footing structure, and a third brace coupled to the first footing structure. The system may include a second footing structure coupled to the lower end of the second leg, and a fourth brace coupled to the second footing structure. The system may include a fifth brace coupled to the second footing structure, and a sixth brace coupled to the second footing structure.

In another respect, the invention is a vessel that includes a platform, three legs coupled to the platform such that the platform may be raised or lowered along the three legs, and a flexible brace coupled to each of the three legs at a first location along each flexible brace. Each flexible brace forms an acute angle with its respective leg. The vessel also includes an anchoring structure coupled to each flexible brace at a second location along each flexible brace. The first and second locations along each flexible brace define a flexible brace length between them, and at least a portion of each flexible brace length is located beneath the platform.

At least one of the flexible braces may be coupled to its respective leg through a footing structure located between that flexible brace and the respective leg. In this embodiment, the footing structure is coupled to one end of the respective leg. The footing structure may include one or more protrusions defining space into which material from a floor beneath a body of water collects when the footing structure contacts the floor.

The anchoring structures to which the flexible braces are coupled may be the same anchoring structure At least one of the anchoring structures may include a winch. At least one of the anchoring structures may include the platform. One or more racks may be secured to at least one of the three legs, and at least one of the anchoring structures may include a holding rack configured to engage one of the one or more racks.

One or more racks may be secured to at least one of the three legs, and at least one of the anchoring structures may include a ring coupled to the platform. In this embodiment, the ring has a holding rack configured to engage one of the one or more racks.

At least one of the three flexible braces may include multiple loops that are linked together. At least one of the three flexible braces may include wire rope. At least one of the three legs may include a metal cylinder. At least one of the three legs may include multiple trusses.

The vessel may include a fourth leg coupled to the platform such that the platform may be raised or lowered along the four legs, and a fourth brace coupled to the fourth leg at a first location along the fourth brace. In this embodiment, the fourth brace forms an acute angle with the fourth leg. In this embodiment, the vessel may also include an anchoring structure coupled to the fourth brace at a second location along the fourth brace. In this embodiment, the first and second locations along the fourth brace define a fourth brace length between them, and at least a portion of the fourth brace length is located beneath the platform.

The vessel may include a fifth leg coupled to the platform such that the platform may be raised or lowered along the five legs, and a fifth brace coupled to the fifth leg at a first location along the fifth brace. In this embodiment, the fifth brace forms an acute angle with the fifth leg. In this embodiment, vessel may also include an anchoring structure coupled to the fifth brace at a second location along the fifth brace. In this embodiment, the first and second locations along the fifth brace define a fifth brace length between them, and at least a portion of the fifth brace length is located beneath the platform.

In still another respect, the invention is a method useful in stabilizing a vessel. The vessel has a platform and three or more legs coupled to the platform such that platform may be raised or lowered along the legs. The method includes coupling a first brace to one of the legs, orienting the first brace at an acute angle with the leg to which it is coupled, and positioning at least a portion of the first brace beneath the platform.

The coupling may include coupling the first brace to one of the three legs through a footing structure located between the first brace and the one leg.

The method may include coupling the first brace to an anchoring structure. The anchoring structure may be the platform. The coupling the first brace to an anchoring structure may include coupling the first brace to the platform through a winch located between the platform and the first brace. The platform may be raised or lowered along the legs using pinions driven by one or more motors, the winch may be driven by a winch motor, and the method may include synchronizing the winch motor with the one or more motors, and raising the platform, whereby tension in the first brace is maintained during the raising. The platform may be raised or lowered along the legs using pinions driven by one or more motors, the winch may be driven by a winch motor, and the method may include synchronizing the winch motor with the one or more motors, and lowering the platform, whereby tension in the first brace is maintained during the lowering.

One or more racks may be secured to the first leg, the anchoring structure may include a ring coupled to the platform, the ring having a holding rack configured to engage one of the one or more racks, and the coupling the first brace to an anchoring structure may include coupling the first brace to the ring.

The first brace may be coupled to one of the three legs at a first location, and the first brace may be secured to the anchoring structure at a second location. In this embodiment, the first brace has a first brace length defined between the first and second locations. In this embodiment, the method may include increasing the first brace length while raising the platform. The method may include decreasing the first brace length while lowering the platform.

The method may include monitoring deflection of one or more of the legs. The method may include tightening the first brace when it becomes slack. The legs of the vessel are oriented in original positions within a body of water, and the method may include lifting a leg that horizontally shifts in order to restore the original position of the leg. The first brace may be rigid. The method may include rotating the first rigid brace, and coupling the first rigid brace to an anchoring structure using at least a pin.

The first brace may be flexible. The method may include coupling a second brace to one of the other two legs, orienting the second brace at an acute angle with the leg to which it is coupled, and positioning at least a portion of the second brace beneath the platform. The method may also include coupling a third brace to the third leg, orienting the third brace at an acute angle with the third, and positioning at least a portion of the third brace beneath the platform. The vessel may include a fourth leg coupled to the platform such that the platform may be raised or lowered along the four legs, and the method may include coupling a fourth brace to the fourth leg, orienting the fourth brace at an acute angle with the fourth leg, and positioning at least a portion of the fourth brace beneath the platform.

In yet another respect, the invention is a system useful in maintaining the position of a platform along three or more legs to which the platform is coupled. One of the legs has one more or racks secured thereto. The platform is coupled to one or more pinions configured to engage the one or more racks. The one or more pinions are also configured for use in raising or lowering the platform along the three or more legs. The system includes a first holding rack configured to engage one of the one or more racks; and a first holding rack actuator configured to cause the first holding rack to engage one of the one or more racks.

The first holding rack may be attached to a ring configured to surround the leg to which one of the one or more racks is secured. The ring may rest in a recess in the platform. The first holding rack may be coupled to the ring through the first holding rack actuator. The first holding rack actuator may be a hydraulic first holding rack actuator.

In another respect, the invention is a method of maintaining the position of a platform along three or more legs. Each of the three or more legs has a lower end. The method includes increasing the distance between the lower ends of the legs and the platform until the platform reaches a first position, and substantially maintaining the platform at the first position. The substantially maintaining includes contacting at least one rack secured to at least one of the legs with at least one non-pinion structure.

The at least one non-pinion structure may include a holding rack configured to engage the at least one rack. The at least one non-pinion structure may include a ring having a holding rack configured to engage the at least one rack.

Two or more racks may be secured to at least one of the legs, and the substantially maintaining may include contacting at least two of the two or more racks with at least two non-pinion structures. In this embodiment, each non-pinion structure is coupled to the platform, and each of the at least two non-pinion structures includes a holding rack. In this embodiment, each holding rack is configured to engage one of the two or more racks.

BRIEF DESCRIPTION OF THE DRAWINGS

The following drawings form part of the present specification and are included to further demonstrate certain aspects of the present systems, vessels, and methods. The present systems, vessels, and methods may be better understood by reference to one or more of these drawings in combination with the description of illustrative embodiments presented herein. These drawings illustrate by way of example and not limitation, and they use like references to indicate similar elements.

DESCRIPTION OF ILLUSTRATIVE EMBODIMENTS

As a preliminary matter, it should be noted that as used herein, the terms "comprise" (and any form thereof, such as "comprises" and "comprising"), "have" (and any form thereof, such as "has" and "having"), and "include" (and any form thereof, such as "includes" and "including") are open-ended transitional terms, meaning that a thing that "comprises," "has," or "includes" one or more elements possesses those one or more elements, but is not limited to those one or more elements. Thus, and by way of example, a brace "having" a first brace portion is a brace that has, but is not limited to, a brace portion. That is, the brace in question possesses a brace portion, but does not exclude other portions or elements that are not expressly recited.

Figure 2:
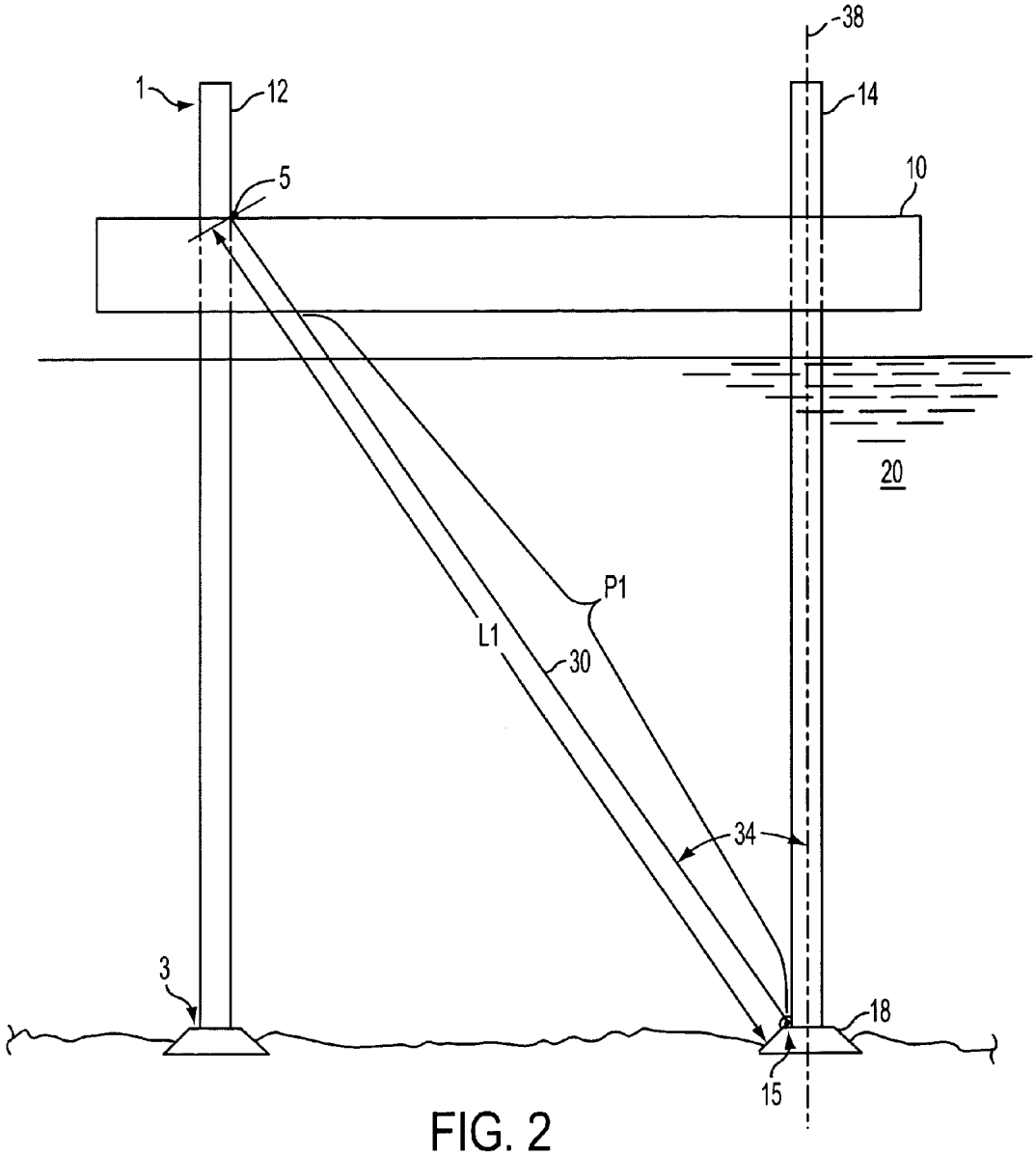
FIG. 2 illustrates one embodiment of the present systems, in which a brace is coupled to a leg.

FIG. 2 illustrates one embodiment of the present systems that are useful in stabilizing vessels, such as liftboats and stationary vessels such as jack-up platforms. As used herein, a "vessel" includes any structure having legs and a platform, which together may be used in the water. FIG. 2 depicts a rear view of a vessel that includes a platform 10, a first leg 12, and a second leg 14, both legs being coupled to platform 10. As used herein, a leg that is "coupled" to a platform is operatively related to the platform in a way that allows the platform to be raised or lowered along the length of the leg. To be "coupled," the leg need not be in direct contact with the platform. Further, as used herein, a "leg" may be any of a variety of structures to which a platform may be coupled. Although legs are typically made of elongated metal cylinders or elongated structures formed from multiple trusses, any structure along which a platform may be raised or lowered may be used as a "leg" consistent with this disclosure. Like all of the legs disclosed herein, first leg 12 has an upper end 1 and a lower end 3. As used herein, upper and lower ends may be, but need not be, the true end of the leg. They may also be the approximate ends of the legs, and may therefore include the portion of the legs extending from the true ends thereof to about 1 to 2 percent of the length of the leg away from the true ends.

Additional legs are not depicted in this figure for ease of understanding, but it will be understood by those skilled in the art having the benefit of this disclosure that vessels such as the one depicted in FIG. 2 may include three, four, five, six, seven, eight, nine, ten, or more legs. In other words, the number of legs of the vessels that the present systems and methods may be useful in stabilizing may be any number required by the task at hand.

Figure 3A:
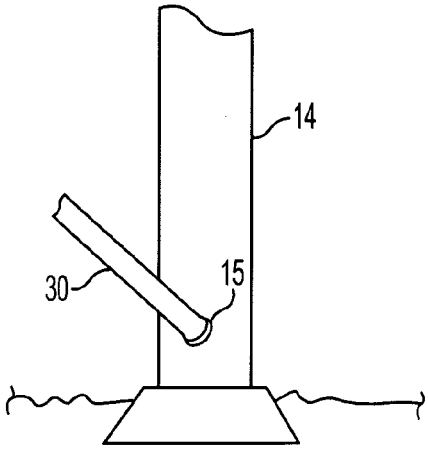
FIG. 3A-D illustrate various manners of coupling one of the present braces to a leg.
Figure 3B:
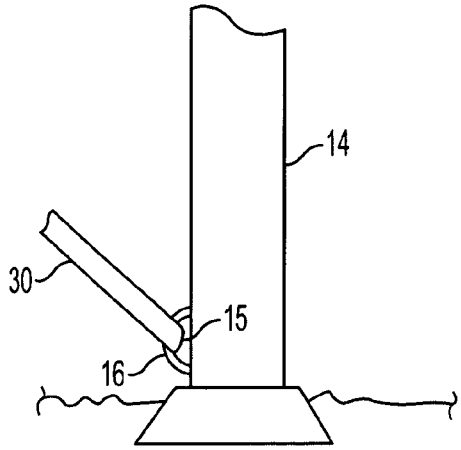
Figure 3C:
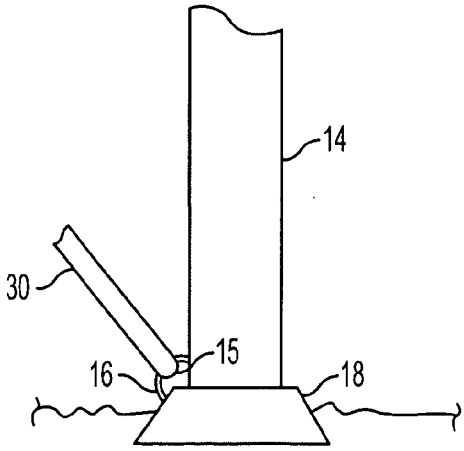
Figure 3D:
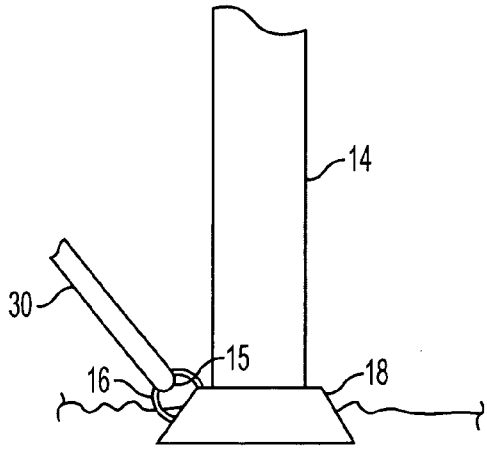

The system depicted in FIG. 2 includes, but is not limited to, a brace 30, which is coupled to second leg 14 at a first location 15 along brace 30, which is illustrated as being at or near the end of the brace that is submersed within water 20. Brace 30 forms an acute angle 34 with second leg 14, and more specifically with centerline 38 of second leg 14. As used herein, a brace that is "coupled" to a leg may be operatively related to the leg in a number of different ways. For example, a brace that is "coupled" to a leg may be secured to the leg itself, such as being looped through or otherwise secured to one or more holes provided in the leg, as illustrated by brace 30, second leg 14, and hole(s) 15 in FIG. 3A; the brace may be looped through or otherwise secured to a device such as a pad eye that is secured, such as by welding or any other suitable means, to the leg, as illustrated by brace 30, pad eye 16, and second leg 14 in FIG. 3B; the brace may be looped or otherwise secured to a device such as a pad eye that is secured to both the leg and a footing structure coupled to the leg, as illustrated by brace 30, pad eye 16, second leg 14, and footing structure 18 in FIG. 3C, which footing structure 18 may be secured to second leg 14 in any manner known to those skilled in the art, such as through welding, integral formation, friction fit, interlocking parts, etc.; the brace may be looped through or otherwise secured to a structure such as a pad eye that is secured to a footing structure coupled to the leg, as illustrated by brace 30, pad eye 16, second leg 14, and footing structure 18 in FIG. 3D. In other words, as will be understood by those of skill in the art having the benefit of this disclosure, a brace that is "coupled" to a leg is operatively related to the leg in a manner that allows a force that (a) acts through the brace and that (b) is directed to or from the joint (i.e., the point of contact) between the brace and the device to which the brace is secured to be transferred at least partially to the leg to which the brace is coupled.

As depicted in FIG. 2, brace 30 is also coupled to an anchoring structure at a second location 5 along brace 30, which second location 5 is spaced apart from first location 15. First location 15 and second location 5 define a first brace length L1 between them. As illustrated in FIG. 2, as is the case with all the brace lengths disclosed herein, at least a portion P1 of first brace length L1 is located beneath platform 10. When brace 30 is in use, i.e., when second leg 14 is firmly planted on the floor beneath the body of water in which the vessel is operating, the length of portion P1 may be more than, equal to, or less than one half of first brace length L1. Moreover, during jacking and lowering, discussed below in greater detail, the length of portion P1 may change, thus making its length variable. Further, second location 5 may be located virtually anywhere, and need not be in the vicinity of one of the legs.

In the system depicted in FIG. 2, the anchoring structure to which brace 30 is coupled may include any of a variety of structures, such as, for example, first leg 12; platform 10; a winch, which may be a windlass, that is secured to platform 10; a wildcat in operative relation with a winch, which may be a windlass, that is secured to platform 10; a brake; a chain stopper; or the like. In essence, all anchoring structures described herein with respect to any of the embodiments of the present systems and vessels—whether they are modified herein by terms such as "first," "second," "third," etc.—include any structures to which a brace may be secured in order to maintain tension in or impart tension to the flexible brace in question, or to maintain compression or impart compression to the rigid brace in question. Furthermore, different braces may be coupled to the same anchoring structure. Anchoring structures in addition to those mentioned above will be discussed in greater detail below. Winches (which include windlasses), wildcats, brakes, and chain stoppers are structures that are well known to those of skill in the art, and do not merit an exhaustive discussion here. It should be noted that winches may be used in conjunction with the present braces that include wire rope or chains, as may windlasses. As used herein, a brace that is "coupled" to an anchoring structure may be operatively related to the anchoring structure as previously described with respect to a brace that is "coupled" to a leg.

Figure 30:
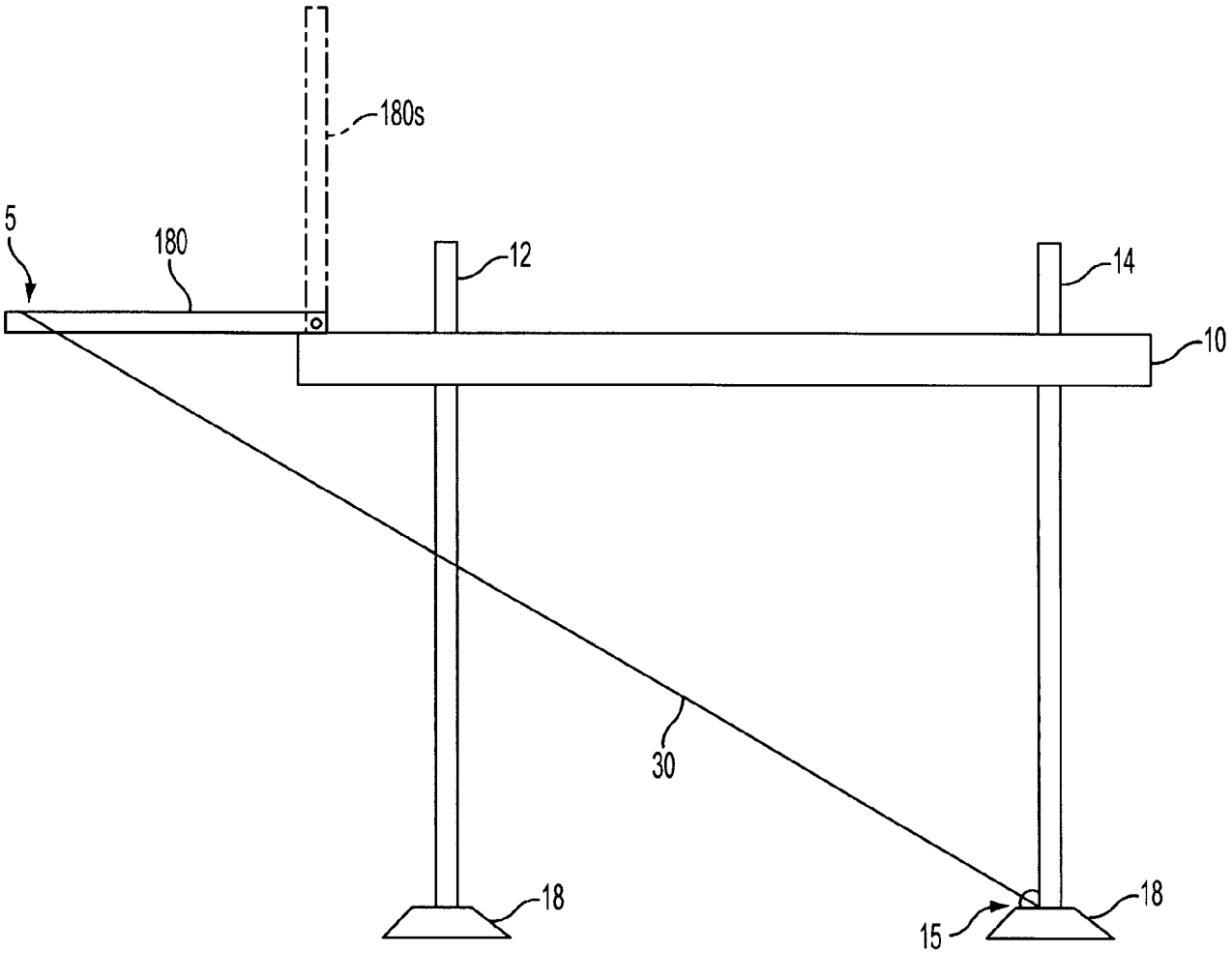
FIG. 30 illustrates one embodiment of the present extensions serving as an anchoring structure for one of the present braces.

Another anchoring structure to which the present braces may be coupled appears in FIG. 30. FIG. 30 illustrates platform extension 180, which may be stored as shown by 180s, coupled to platform 10. The hinge or other fastener coupling platform extension 180 to platform 10 should be sturdy. Platform extension 180 is one embodiment of the present anchoring structures and may be, for example, a cantilever arm.

Figure 4:
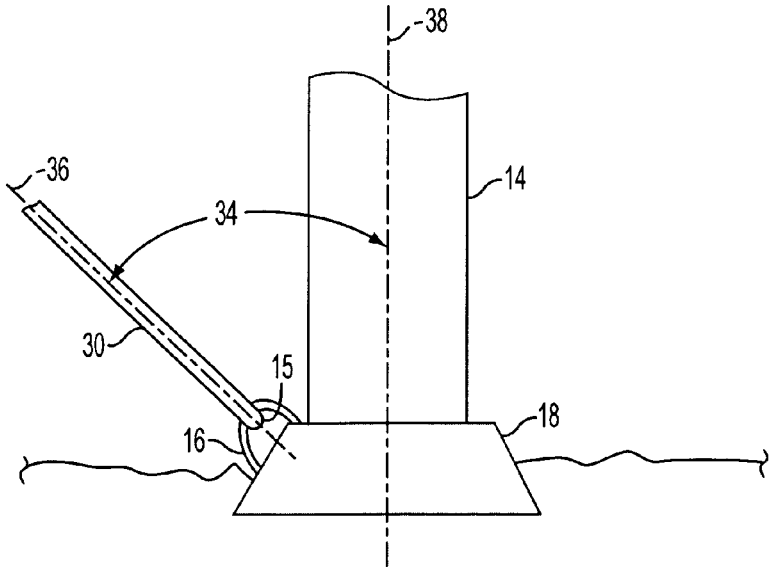
FIG. 4 illustrates one of the present braces positioned at, or forming, an acute angle with the leg to which it is coupled.

As illustrated in FIGS. 2 and 4, brace 30 forms an acute angle 34 with second leg 14. A determination of the angle formed between brace 30 and second leg 14 may be made by observing the angle between centerline 36 of brace 30 and centerline 38 of second leg 14. In cases in which either second leg 14 or brace 30 is not a symmetrical structure, the centerline of that structure may be approximated in order to determine the value of angle 34. It should be noted that this determination will not be difficult to those of skill in the art having the benefit of this disclosure, because acute angles are generally very easy to ascertain. All the braces in this disclosure form acute angles as just described with the legs to which they are coupled, even when the only coupling between the brace in question and the leg in question exists because the anchoring structure to which the brace is coupled includes the leg.

As shown in FIG. 4, brace 30 is coupled to second leg 14 by virtue of brace 30's connection to pad eye 16, which is secured to footing structure 18 using any suitable means. In turn, footing structure 18 is coupled to second leg 14 as described above. The "coupled" relationship between brace 30 and second leg 14 that is illustrated in FIG. 4 may be described herein as brace 30 being coupled to second leg 14 through a footing structure located between brace 30 and second leg 14. As used herein, a device or structure that is located "between" two other structures need only separate the two other structures in some way. For example, the device or structure in question need not be positioned such that the two other structures are both in physical contact with the device or structure in question for the same to be "between" those two other structures. In other words, considering five consecutive links in a chain, the third link from either end is located "between" the outermost links as the term "between" is used herein. Additionally, should the two other structures be in physical contact with the device or structure "between" them, the two other structures need not be positioned at opposite ends of the device or structure in question for that device to be "between" them. In the case illustrated in FIG. 4, brace 30 is coupled to second leg 14 through not only footing structure 18, but also through pad eye 16. Like footing structure 18, pad eye 16 is located between brace 30 and second leg 14.

Figure 5:
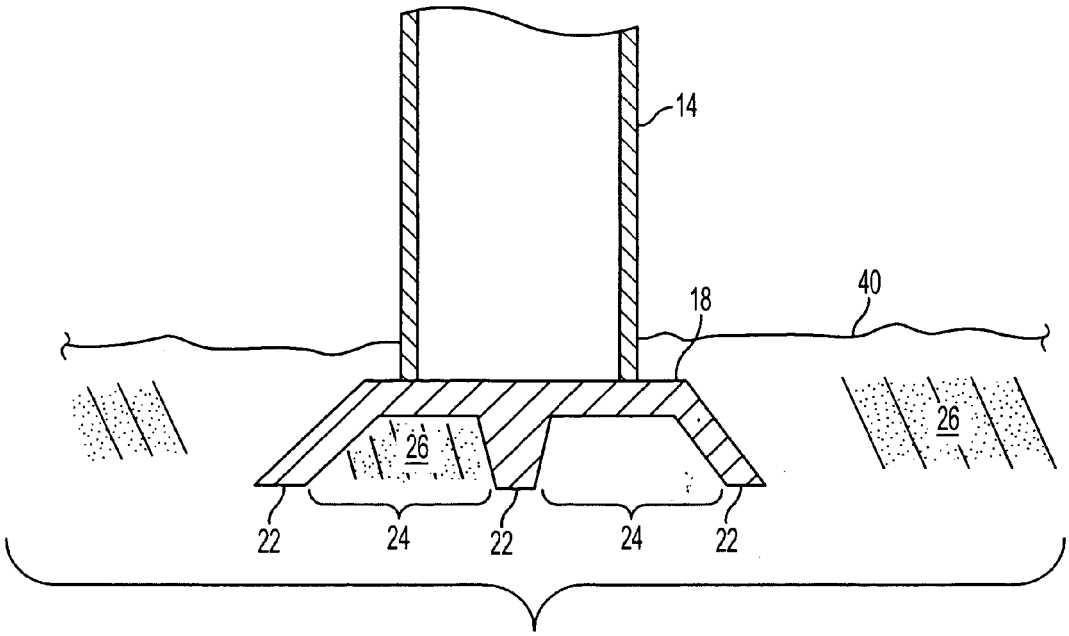
FIG. 5 is a cross-sectional view of one of the present footing structures coupled to a leg.

Footing structure 18 may possess any suitable shape. One such shape includes the shape depicted in FIG. 5. Specifically, FIG. 5 depicts a cross-sectional view of second leg 14 secured to footing structure 18. Footing structure 18 is illustrated with protrusions 22 that define space 24 into which material 26, which is material from floor 40, collects when footing structure 18 contacts floor 40 and any of the weight of the structures to which footing structure 18 is coupled is directed through footing structure 18 toward floor 40. In other words, as illustrated in FIG. 5, this collection may take place when footing structure 18 contacts floor 40. Because footing structure 18 has this configuration, material 26 that collects within space 24 tends to be compacted, as does material 26 that exists outside of space 24 but beneath footing structure 18. As a result, this compaction resists further downward movement by footing structure 18, thereby allowing footing structure 18 to more rapidly stabilize than do footing structures that lack such protrusions, such as those footing structures that are cup-shaped. Cup-shaped footing structures displace material 26 rather than compact it, and, as a result, the legs to which such footing structures are attached may sink unnecessarily deep into floor 40. Those of skill in the art having the benefit of this disclosure will understand that central protrusion 22 shown in FIG. 5 need not be provided in certain embodiments. The footing structure depicted in FIG. 5 may be used for any of the footing structures of the present vessels and systems.

Figure 29:
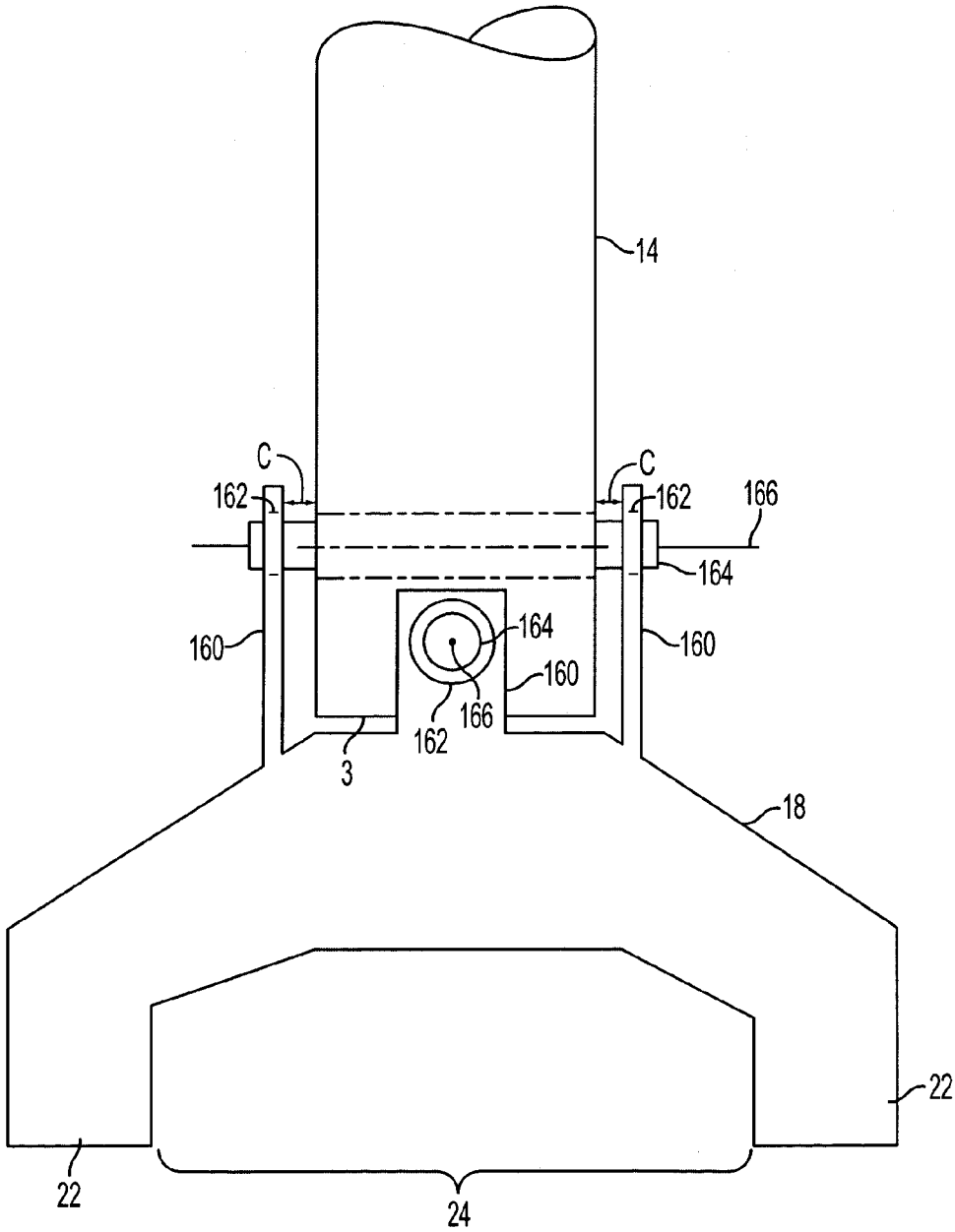
FIG. 29 illustrates one embodiment of one of the present footing structures that is hinged in two locations for movement along at least two axes.

The inventor has come up with one way of addressing the problems associated with uneven floors beneath the bodies of water in which the present vessels may operate. FIG. 29 illustrates footing structure 18 coupled to second leg 14. As shown, footing structure 18 has protrusions 22 that define space 24. Footing structure 18 is also provided with pin supports 160 that have openings 162 sized to receive pins 164. FIG. 29 also illustrates that second leg 14 is also provided with openings 162 near its lower end 3 that are sized to receive pins 164, which have axes 166. These openings may be arranged at 90 degrees to one another, such that second leg 14 is capable of rotating around two axes 166 arranged at 90 degrees to one another. The extent of rotation is determined by the amount of clearance C noted between second leg 14 and pin supports 160. This arrangement may prove useful in an environment having uneven floors. During preloading (discussed briefly below), such uneven spots should be discovered. Footing structure 18 can rotate about either axis 166 in order to prevent second leg 14 from bending, when the footing structure comes to rest on an uneven spot, or a particularly hard spot. Pins 164 may be 6 inches in diameter, or any other diameter suited to the leg and footing structure through which they may be placed.

Figure 1:
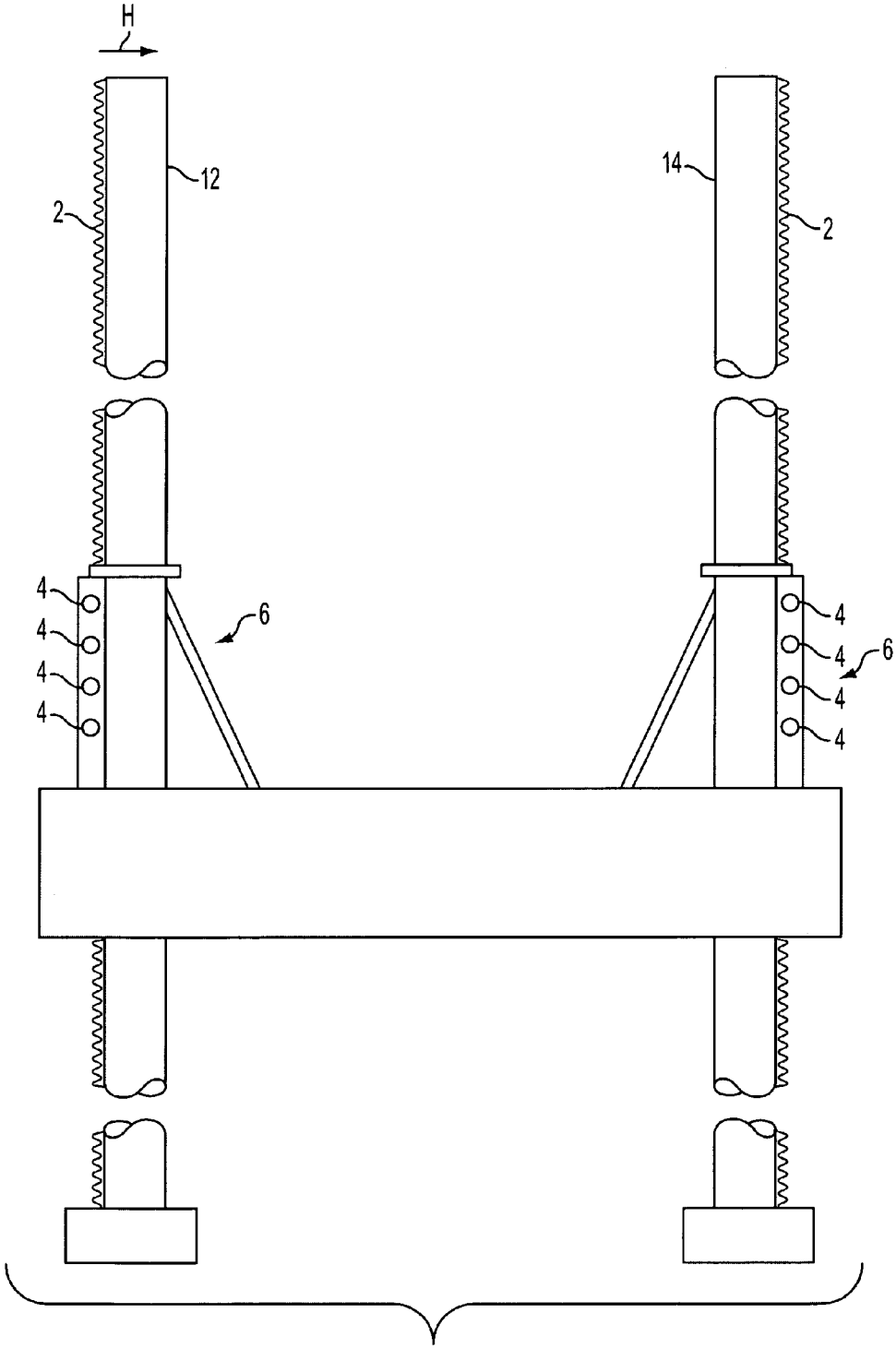
FIG. 1 illustrates a traditional vessel, sometimes referred to as a liftboat.
Figure 6:
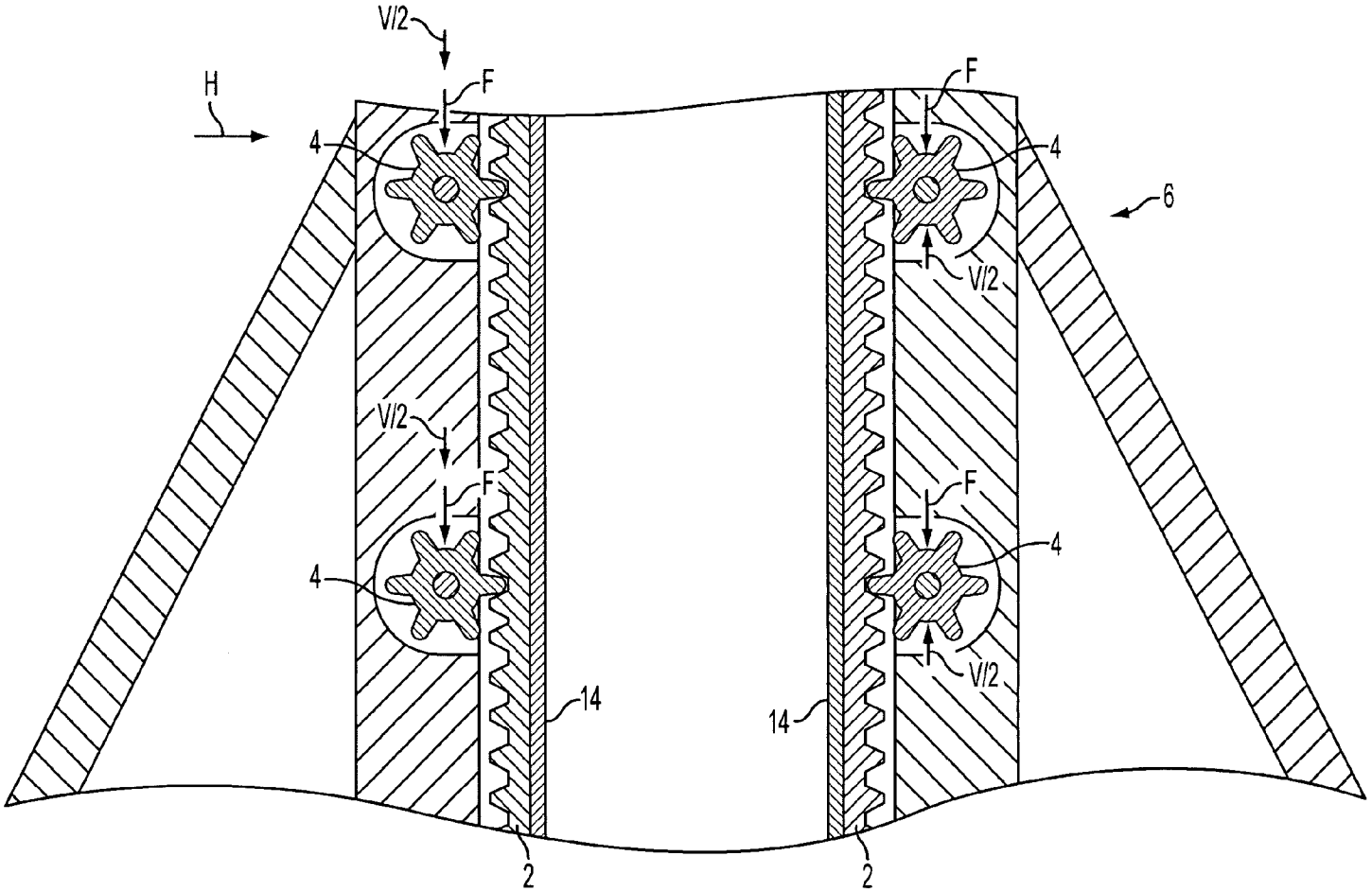
FIG. 6 is a cross-sectional view of a conventional leg to which racks are secured and a leg tower is coupled; the leg tower includes multiple pinions engaged with the racks.

As previously described, with respect to the vessels described herein, the platform may be raised or lowered along the legs to which the platform is coupled using a driving, or jacking, mechanism that includes a combination of one or more racks and one or more pinions. FIG. 1, which illustrates a conventional version of the types of vessels the present systems may be useful in stabilizing, depicts such a rack 2 secured to each of first leg 12 and second leg 14, along with multiple pinions 4, the details of which are hidden from view. Rack 2 may be secured to second leg 14 using any method well known to those of skill in the art. While only one rack is secured to each leg in FIG. 1, multiple racks, as illustrated in FIG. 6, may be secured to any given leg. Further, pinions 4 may be secured to leg tower 6 using any method known to those skilled in the art. In general terms, a leg tower is a conventional structure that transmits the weights of the platform and any cargoes thereon (described herein as force F). Leg towers are attached to platforms through any suitable means, including nuts and bolts, welds, interlocking parts, etc. Typically, each portion of the leg tower that contains pinions is flanked by a bracing structure that is connected to the platform as just described (e.g., see element 300 in FIG. 9). A leg tower also provides what is known by some in the art as "grip" on the leg in question; in other words, a leg tower can impart a fixing moment to a leg. As leg towers are structures well known to those skilled in the art, the inventor does not believe they merit an exhaustive discussion here.

FIG. 6 depicts an enlarged, cross-sectional view of second leg 14, racks 2, pinions 4, and leg tower 6. FIG. 6, which is provided to clearly illustrate the relationship between pinions and a rack, illustrates that pinions 4 are configured to engage racks 2. When the driving mechanism (not shown in FIG. 6) coupled to the pinions is actuated, the pinions rotate and, depending on the direction they rotate, raise or lower the platform up or down along the legs if the position of the legs relative to the surroundings remains unchanged (e.g., such as when the legs have firmly contacted the floor of the body of water in which the vessel is positioned), or raise or lower the legs through the platform if the position of the platform relative to the surroundings remains unchanged (e.g., such as when the legs are being advanced toward the floor of the body of water in which the vessel is positioned after advancing the vessel to the desired location in the body of water). It will be understood, however, that as the difference in wording between these descriptions is due only to perspective, both are equivalent in meaning and may be used interchangeably throughout this disclosure. In most conventional vessels, the pinions that are utilized are constantly engaging the rack(s) while the vessel is in transit and while the vessel is stationary and the platform is positioned at a given height.

Those of skill in the art having the benefit of this disclosure will understand that one or more racks may be secured to a given leg, and one or more pinions may be secured to a given leg tower. When one or more racks and one or more pinions (also known to those skilled in the art as "driving pinions") are used to jack, or raise, the platform along the legs (a process known to those skilled in the art as "jacking" or as the "jack-up operation"), those pinions share the full load F (FIG. 6) of the platform, which may thought of as a static load, during raising or lowering. Further, once the platform has been raised to the desired height, the driving pinions typically remain engaged with the racks to maintain the position of the platform along the legs. As a result, these pinions take these same full loads once the platform has been jacked to the desired height.

Returning to FIG. 1, should a horizontal force H from the wind, waves, or current act on any part of the vessel in the general direction indicated by the arrow beneath H, second leg 14, which may be characterized as being on the lee side, will be loaded with an extra vertical load; and first leg 12, which may be characterized as being on the windward side, will be relieved of the extra vertical load. When two racks are secured to a given leg, such as in FIG. 6, the windward pinions will be subject to an additional force V (illustrated as V/2), which may be thought of as a dynamic load. This dynamic load can act both during jacking and once the platform has reached a predetermined height. These additional vertical loads V may be almost equal to loads by the weight of the platform and cargoes for vessels with long legs (i.e., on the order of 300 feet). For vessels whose legs are fairly short (i.e., on the order of 100 feet), the driving pinions are usually locked and carry the total loads because the additional loads from force V (whatever its magnitude) may only come to about 25% of the total forces on the pinions.

Figure 7:
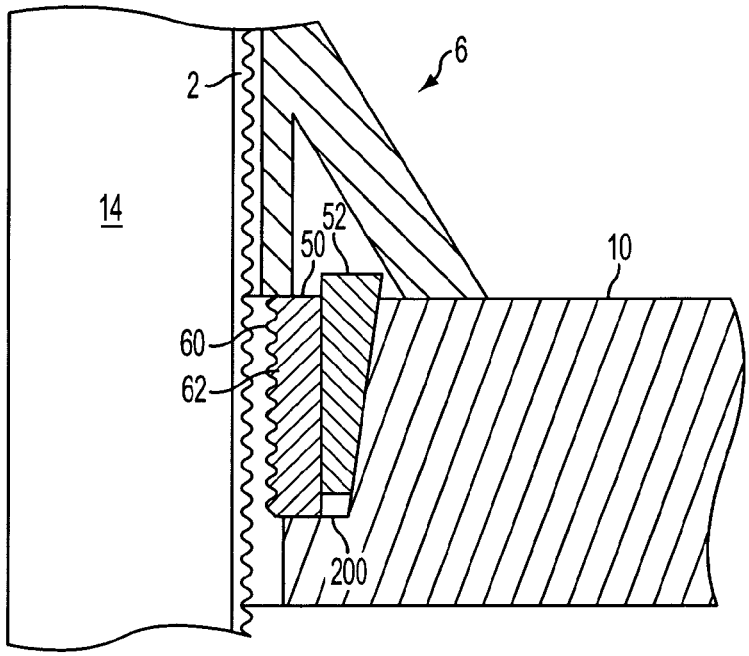
FIG. 7 is a cross-sectional view of a leg to which a rack is secured, and one embodiment of the present holding racks, which holding rack is configured to engage the rack.

The inventor has come up with a system that is useful in maintaining the position of a platform in a way that relieves the pinions, at least partially and potentially fully, of the aforementioned loads that result at a given height after the lifting operation is complete. One embodiment of this system is illustrated in FIG. 7. FIG. 7 is a cross-sectional view illustrating second leg 14, rack 2, which is secured to second leg 14, a portion of platform 10, and holding rack 50 that is configured to engage rack 2. Only a portion of platform 10 is illustrated in FIG. 7 for simplicity. No leg tower or pinions are illustrated for the same reason. It will be understood that while the present system may be useful in maintaining the position of a platform using only one holding rack, multiple holding racks, especially opposing holding racks, may also be used (see FIG. 9, discussed in greater detail below). The holding racks herein may be described as non-pinion structures. As used herein, a "non-pinion structure" is a structure other than a pinion that is adapted for use in securing a platform to one or more legs, and includes pins that may be driven through both a portion of a platform and a leg, the present holding racks, and any other suitable structure for achieving this purpose, such as a combination of pins and eyes, or one or more hydraulic cylinders. Additionally, the present holding racks may also form part of the present systems that are useful in stabilizing vessels.

As shown in FIG. 7, holding rack 50 includes teeth 60 and grooves 62. As used herein, a holding rack that is "configured to engage" another rack is structured such that the teeth and grooves on the holding rack fit, or mesh, with the grooves and teeth on the rack in mating fashion. As used herein, the number of teeth and grooves of one of the present holding racks that is "configured to engage" another rack need not match the number of grooves and teeth of that rack. The present holding racks should have as many teeth as necessary to carry the loads imposed, taking into account, of course, the number of holding racks used, etc. For example, if the anticipated dynamic load, discussed above, becomes equal to the full load (F above), for example, twice as many teeth should be utilized as would otherwise be utilized when only the full load is anticipated. In this example, a guide for the number of teeth would be by comparison to the number of pinions normally used. Thus, in this example, twice as many teeth as the number of pinions for supporting only load F described above may be used. A holding rack actuator 52 is also included in the embodiment of the system illustrated in FIG. 7, and may be configured to cause holding rack 50 to engage rack 2. As illustrated in FIG. 7, holding rack actuator 52 may possess a wedge shape. Holding rack actuator 52 may be operated using any suitable means, including hydraulics, electric power, brute force, etc. such that it causes holding rack 50 to engage rack 2. Holding rack 50 may be placed within recess 200 (which may be sized to accommodate both holding rack 50 and holding rack actuator 52) provided in platform 10. The holding rack need not be secured to platform 10 using any fasteners or the like when, for example, a wedge-shaped holding rack actuator like the one depicted in FIG. 7 is utilized. As will be discussed in greater detail below with respect to FIG. 25, for example, the present holding racks may be coupled to platform 10 through a holding rack actuator that is secured to platform 10.

Figure 8:
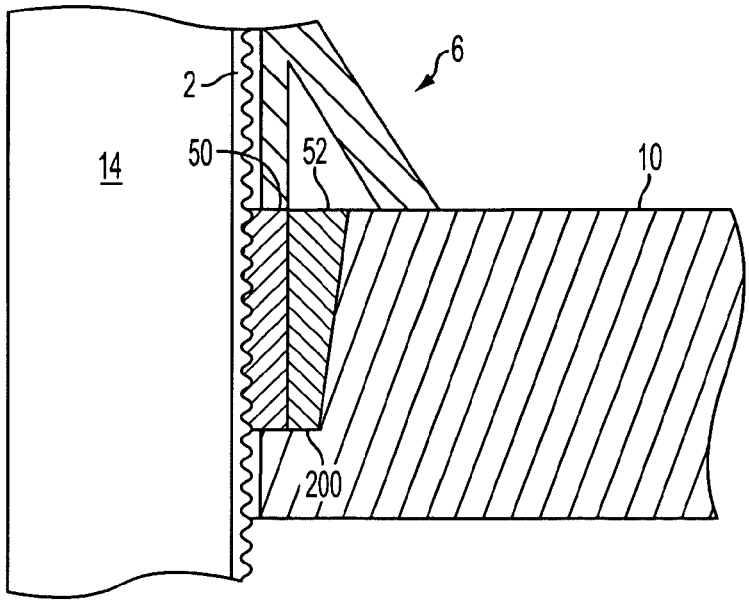
FIG. 8 is the cross-sectional view depicted in FIG. 7 with the difference being the holding rack is engaged with the rack.

FIG. 8 is a cross-sectional view illustrating the embodiment of the system illustrated in FIG. 7 in which holding rack 50 is engaged with rack 2. As used herein, a holding rack "engages" with a rack when the teeth and grooves of the holding rack mesh with multiple grooves and teeth of that rack. As a result of the engagement between holding rack 50 and rack 2, the driving pinions that would otherwise take the loads described above may be relieved of those loads (i.e., disengaged from rack 2), and the holding rack may take on those same loads. The driving pinions can remain engaged with the rack, and the aforementioned loads will then only be partially transferred to the holding rack. In either case, the loads absorbed by the holding rack (or racks as the case may be) are ultimately transferred partially or completely to the relevant leg.

The number of holding racks that may be used consistently with this disclosure is unlimited—one may use as many holding racks as one wishes to accomplish the task at hand. Thus, one, two, three, four, five, six, seven, eight, nine, ten, or even more holding racks may be configured for use with a single leg, depending on the number of racks that are secured to the leg. Furthermore, this system may include more than one holding rack (i.e., two, three, four, five, six, seven, eight, nine, ten, or even more holding racks) that is configured to engage a single rack that is secured to a leg. That is, other embodiments of this system may include multiple holding racks that are positioned in vertically spaced apart relationship with one another, and which are each configured to engage a single rack secured to a given leg. Similarly, other embodiments of this system in which multiple racks are secured to a given leg include multiple holding racks positioned in vertically spaced apart relationship with one another, and which are each configured to engage a single rack secured to a given leg such that multiple holding racks exist for each rack.

Figure 10:
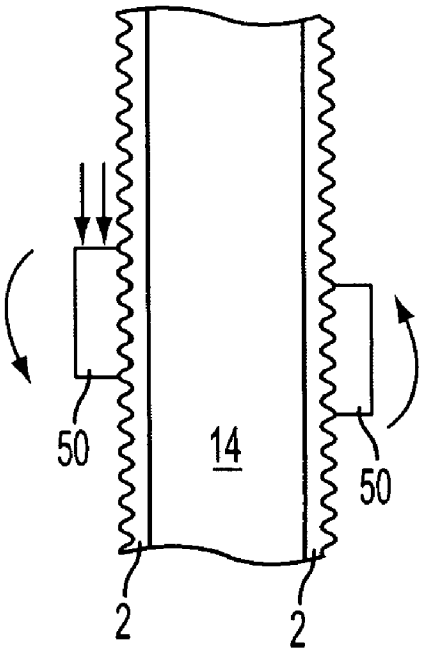
FIG. 10 is a cross-sectional view without the hatching that depicts a bending stress that may be placed on a leg when the racks secured to the leg are misaligned.
Figure 9:
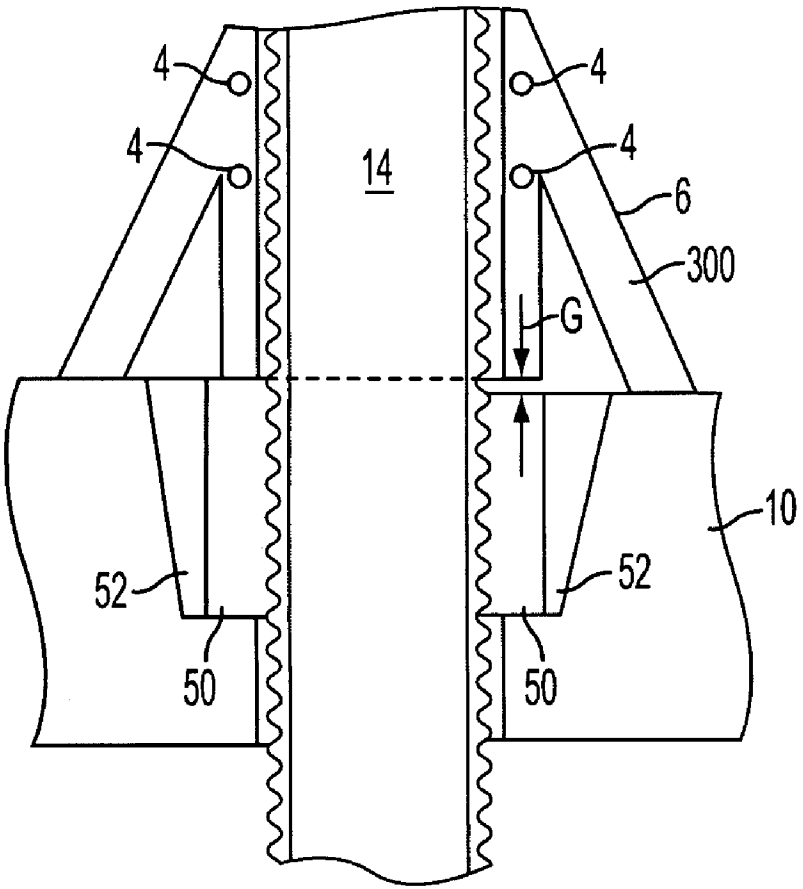
FIG. 9 is a cross-sectional view lacking the cross hatching for simplicity that illustrates an embodiment of the present systems useful in maintaining the position of a platform, which view includes holding racks and holding rack actuators configured to cause the holding racks to engage the racks secured to the leg depicted, and which also includes a gap that may exist due to misalignment of the racks secured to the leg.

FIG. 9, which is a cross-sectional view without the typical cross-sectional hatching for simplicity, illustrates another embodiment of a system useful in maintaining the position of a platform. FIG. 9 illustrates second leg 14 to which racks 2 have been secured. A portion of leg tower 6 is illustrated, and the outside of pinions 4 are shown. Holding racks 50, along with holding rack actuators 52, are also illustrated. Further, platform 10 is shown. Of special interest in FIG. 9 is gap G, which is the gap that exists between the top of one of the holding racks and the bottom of the leg tower. It should be noted that gap G is not drawn to scale, but is instead enlarged for ease of viewing. As driving racks will not be misaligned by more than half of the distance between two teeth, the maximum gap G that could exist in one embodiment of the present systems is approximately one inch. Because of gap G, the weight of the platform, which will act through leg tower 6, will fall first on the higher holding rack 50, leading to a bending stress on second leg 14, as illustrated by the arrows in FIG. 10, which is also a cross-sectional view without the hatching (other features are also omitted for simplicity). Such a bending stress, should it exist, may be larger than the stresses do to dynamic loads; accordingly, such a bending stress should be avoided.

Gap G illustrated in FIG. 9 is due, for example, to opposing racks that do no line up. This can occur, for example, due to wear and tear on the racks or expansion of the racks from heat. The inventor has come up with various ways of addressing problems that may result from the existence of gap G. For example, one way of avoiding the aforementioned bending stress is to relax the tolerances associated with the location of the racks along a given leg so as to increase the chance that the racks will be aligned. This may prove to be an expensive approach.

Figure 11A:
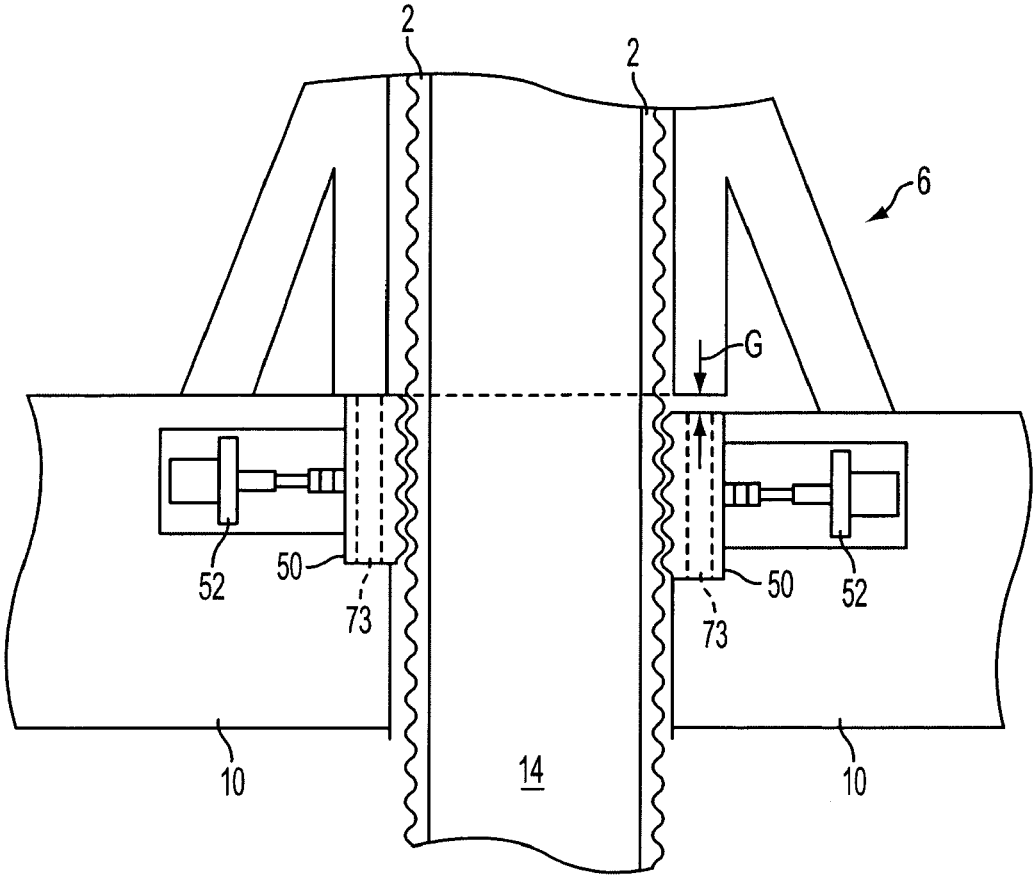
FIG. 11A is a cross-sectional view without the hatching that depicts another embodiment of the present systems useful in maintaining the position of a platform, which view includes holding racks and hydraulic holding rack actuators configured to cause the holding racks to engage the racks secured to the leg depicted.

FIGS. 11A and B show an alternative embodiment for causing the present holding racks to engage the racks secured to the legs. FIG. 11A is a cross-sectional view (without the hatching) that illustrates holding racks 50 and holding rack actuators 52, which are configured to cause holding racks 50 to engage racks 2 secured to second leg 14. As shown, holding rack actuators 52 are hydraulic holding rack actuators, which each have a hydraulic cylinder that may be operated to engage and disengage the holding rack to which the holding rack actuator is coupled. A hydraulic torque motor, not shown but well know in the art (such motors have been used in conventional vessels to drive the pinions discussed earlier), may be used to drive the present hydraulic holding rack actuators. Moreover, any suitable mechanical device may used to achieve the movement of the present hinged holding racks. Hydraulic holding rack actuators 52 may be secured to platform 10 in any suitable fashion, such as through the use of nuts and bolts, welds, friction fit, interlocking parts, etc. FIG. 11A also illustrates that holding racks 50 may be hinged. Specifically, a vertically-oriented (or substantially vertically-oriented) opening 73 is shown running through holding racks 50. A hinge pin, which is not shown, may be positioned within opening 73 and secured to platform 10 in a manner that allows the holding rack to rotate about that hinge pin as the holding rack is engaged, and disengaged, with the rack 2.

Figure 11B:
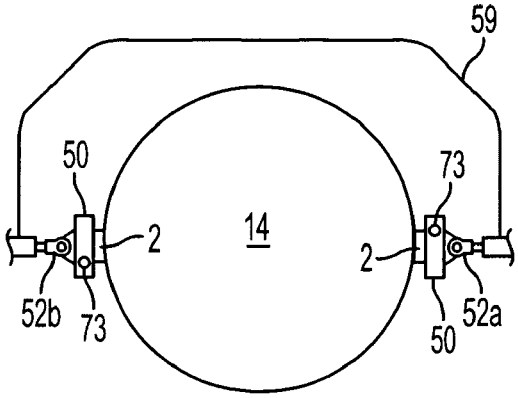
FIG. 11B is a top view showing how the hydraulic holding rack actuators depicted in FIG. 11A may be linked by a hydraulic fluid line.

As shown in FIG. 11B, which is a top view of the embodiment illustrated in FIG. 11A (but not proportional thereto, and it lacks various features like platform 10 for simplicity), hydraulic holding rack actuators 52*a* and 52*b* may be linked by line 59, which may be a hydraulic oil supply equalizing line configured to better ensure that an equal vertical load exists on holding racks 50. Line 59 may be run, or placed, in any convenient location, including above the platform, within a recess in platform 10, etc. When more than two holding racks are utilized with respect to a given leg, line 59 may be configured to be linked to each holding rack actuator.

One manner of eliminating gap G when it is small (i.e., roughly the height of the slope of a tooth on either a driving rack or one of the present holding racks) may be effected using the present hydraulic holding rack actuators. This manner is one way of minimizing the construction tolerances associated with addressing the problems that may be associated with gap G. With reference to FIG. 11B, should a gap exist above the holding rack coupled to hydraulic holding rack actuator 52*b*, hydraulic holding rack actuator 52*a* may be pressurized (or more particularly, the hydraulic cylinder of hydraulic holding rack actuator 52*a* may be pressurized), causing the holding rack to which it is coupled to engage the rack secured to second leg 14 such that gap G will start to close. Then, the holding rack to which hydraulic holding rack actuator 52*b* is coupled may be moved. If it is possible to disengage it, some gap still exists. To further eliminate the gap, hydraulic holding rack actuator 52*a* may again be pressurized, forcing the holding rack to which it is coupled to push second leg 14. This process may be repeated until gap G is eliminated to the satisfaction of the operator. The holding racks may then be locked by opening a valve located on hydraulic line 59 to equalize the pressure side of the hydraulic line 59.

Another manner of eliminating gap G is described with reference to FIGS. 11F-I. FIG. 11F illustrates a top view of second leg 14 to which racks 2 are secured, platform portions 10*a*, holding racks 50 having teeth 60 (the grooves are not visible), and holding rack actuators 52. As shown, both holding racks 50 and platform portions 10*a* are wedge-shaped. The dashed lines appearing in racks 2 indicate the unseen grooves disposed on the racks. FIG. 11F, as have FIGS. 11G-I, has been simplified by omitting platform 10 and other features that are shown in other figures. Both holding rack actuators 52 (which, as shown in FIG. 11F, are hydraulic) and platform portions 10*a* may be secured to the platform in any suitable fashion, including pursuant to the manners of attachment described herein, such as integral formation, nuts and bolts, etc. Whereas FIG. 11F shows a top view in which holding racks 50 are not engaged with racks 2, FIG. 11G shows the same top view, but with holding racks 50 engaged with racks 2.

Figure 11C:
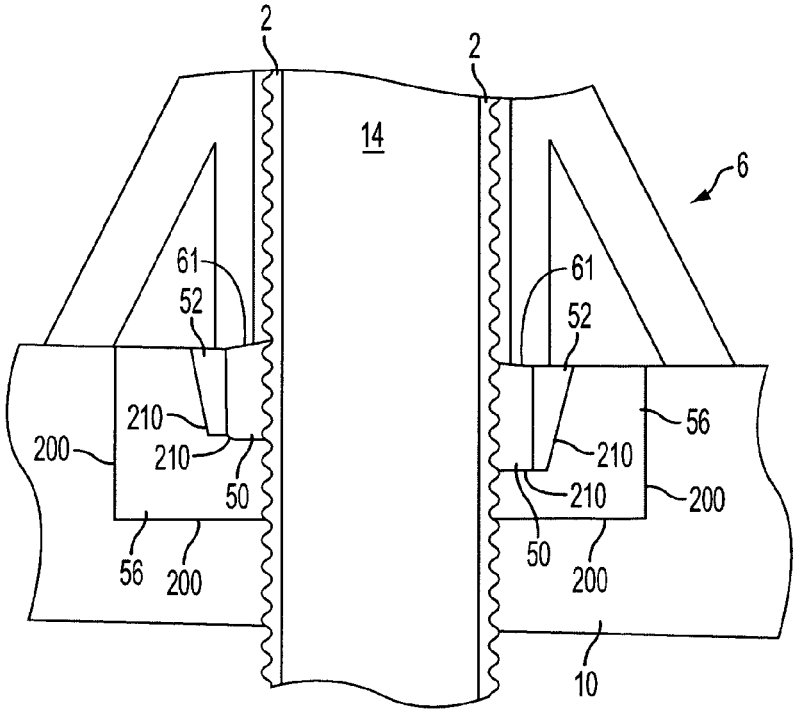
FIG. 11C is a cross-sectional view without the hatching depicting one embodiment of a ring that may be utilized in a system useful in maintaining the position of platform, which ring may also be used in a system useful in stabilizing a vessel; the view also depicts that the present holding racks may be sloped.
Figure 11D:
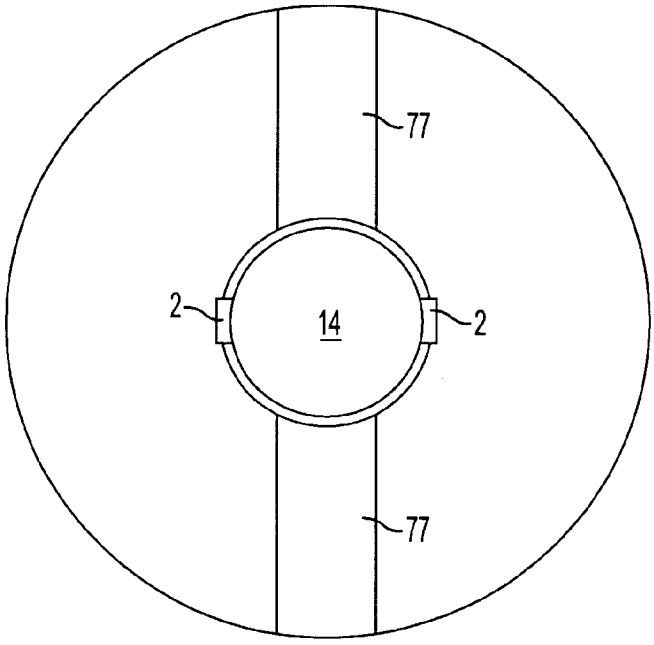
FIG. 11D is a top view of one embodiment of a ring that has rounded portions.
Figure 11E:
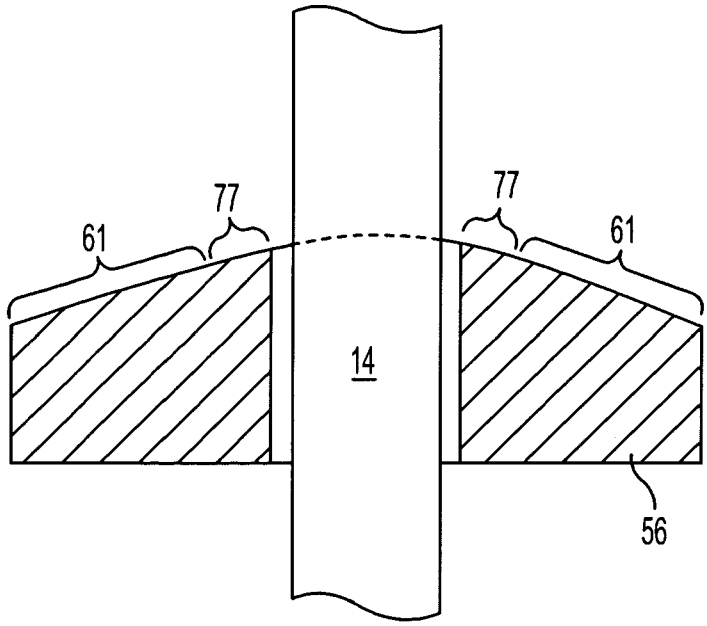
FIG. 11E is a cross-sectional view of an embodiment of a ring that has both rounded and sloped portions.
Figure 11F:
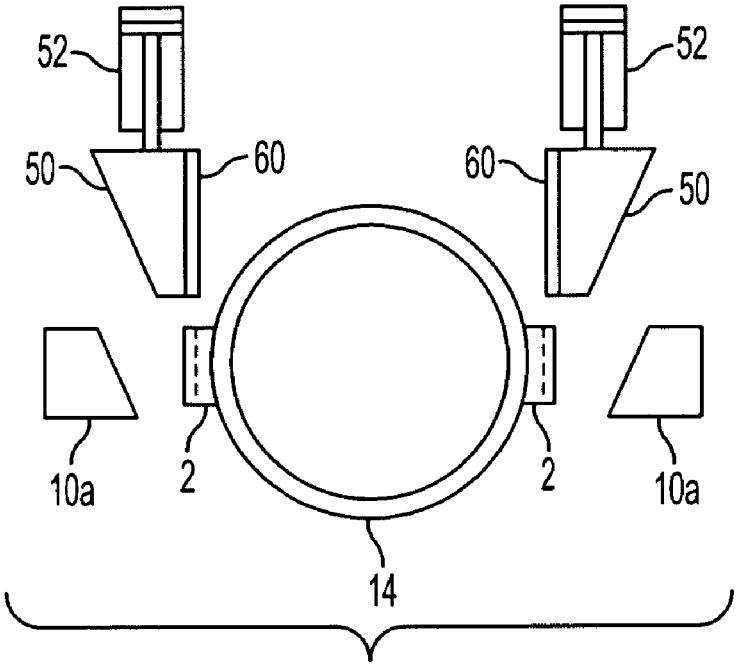
FIG. 11F is a top view of an embodiment in which holding racks are not engaged with driving racks secured to a leg.
Figure 11G:
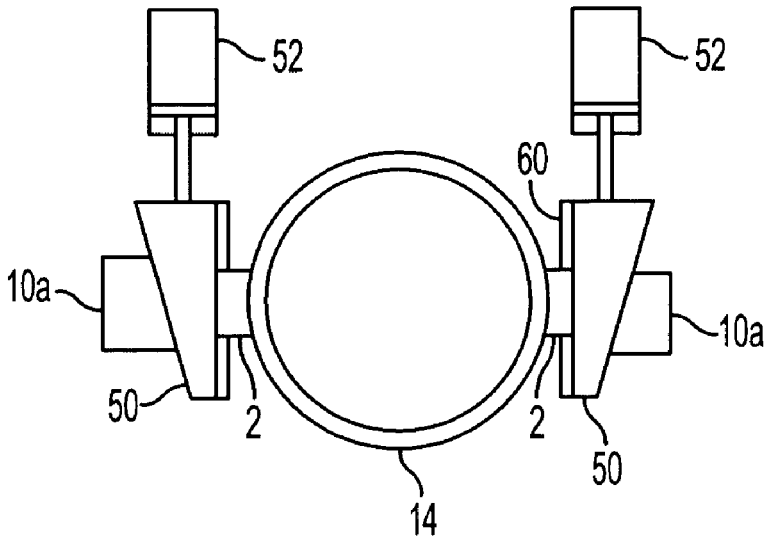
FIG. 11G is a top view of the embodiment depicted in FIG. 11F in which the holding racks are engaged with the driving racks.
Figure 11H:
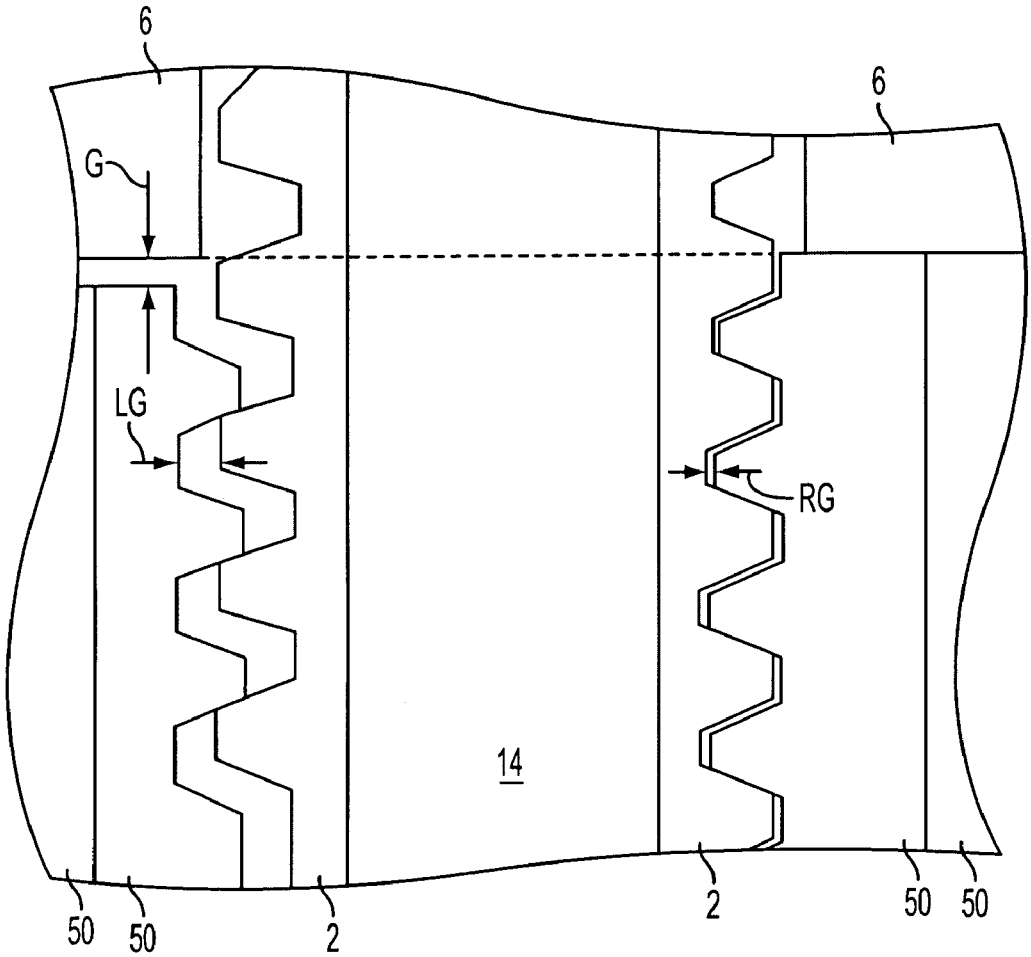
FIG. 11H is a cross-sectional view without the hatching of the embodiment depicted in FIG. 11G in which gaps LG and RG exist.
Figure 11I:
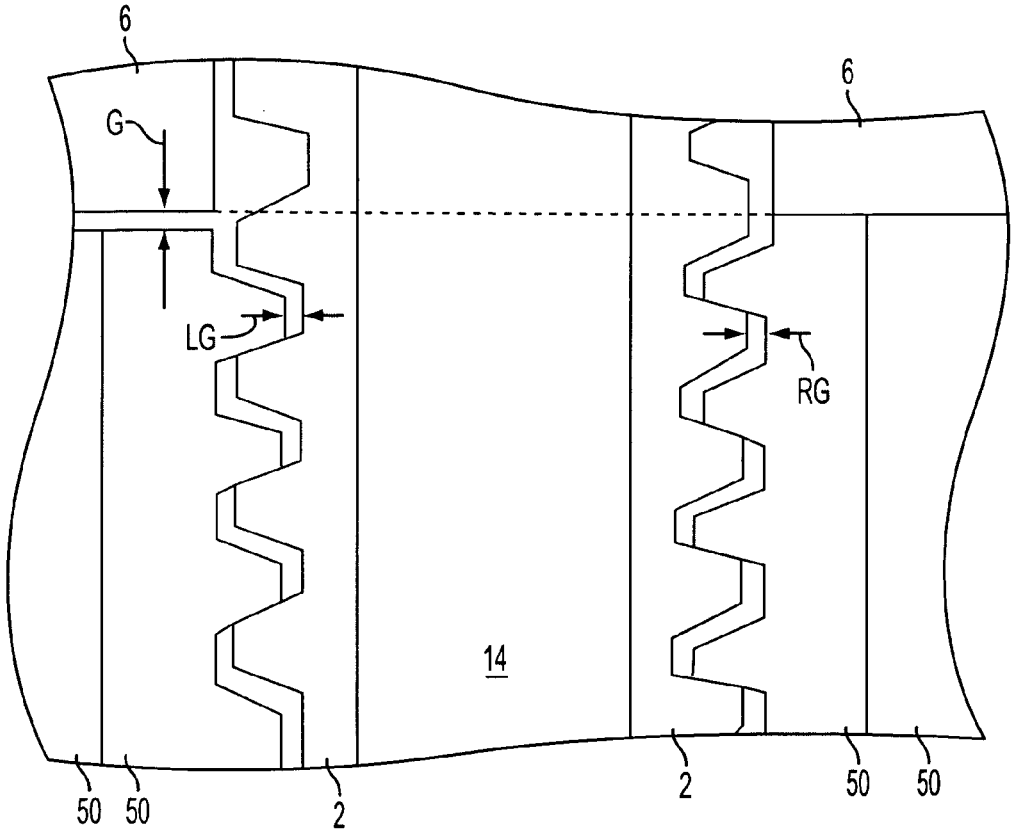
FIG. 11I is a cross-sectional without the hatching of the embodiment depicted in FIG. 11H in which gap LG has been decreased and gap RG has been increased.

Turning next to FIGS. 11H and I, FIG. 11H shows a cross-sectional view without the hatching of the embodiment depicted in FIG. 11G. Additionally, FIG. 11H shows that gap G exists beneath leg tower 6 and left holding rack 50 ("left" being a relative term to the viewer), while no gap exists between the right holding rack 50 and leg tower 6. This condition may exist after the operator has brought some or all of the weight of the platform and its cargoes to bear on the holding racks by disengaging one or more of the driving pinions (not shown) from racks 2. FIG. 11H also illustrates gap RG, which may exist between the right holding rack and the right rack, and gap LG, which may exist between the left holding rack and the left rack. These gaps LG and RG may be useful to the operator in eliminating gap G as will be described in more detail shortly. Thus, the weight of the platform and its cargoes should be brought to bear on the holding racks with these gaps in place. Afterwards, gap LG may be decreased through operation of the relevant holding rack actuator; consequently, gap G is decreased because holding rack 50 is elevated with respect to the driving racks and the leg. (Compare FIG. 11I to FIG. 11H to see the decrease in gap LG.) Correspondingly, gap RG may be increased through operation of the relevant holding rack actuator. By increasing gap RG, leg tower 6 will be lowered with respect to the driving racks and the leg. (Compare FIG. 11I to FIG. 11H to see the increase in gap RG.) Since this lowering will occur with the respect to the entire leg tower, gap G will be further decreased. (Compare FIG. 11I to FIG. 11H to see the decrease in gap G that may result from these operations of the holding rack actuators.) In other words, by decreasing gap LG, gap G is decreased due to the elevation of the left holding rack; and by increasing gap RG, gap G is decreased due to the lowering of the leg tower. Operating the holding rack actuators to this end may be repeated until gap G is suitably eliminated. A line (not shown) may be coupled to both holding rack actuators and operated to lock the position of the holding racks (e.g., line 59 depicted in FIG. 11B, which is a hydraulic oil supply equalizing line).

The present holding rack(s) may also be implemented in a ring, as illustrated in FIGS. 11C and D. FIG. 11C is a cross-sectional view (without the hatching) that illustrates ring 56 having holding racks 50, which are configured to engage racks secured to a leg. Ring 56 may be made from any suitable material, including metal. Ring 56 rests within recess 200 provided within platform 10. Similarly, holding racks 50 and holding rack actuators 52 rest within ring recess 210. As shown in FIG. 11C, holding racks 50 may be provided with sloped surfaces 61. These sloped surfaces are configured to maximize the contact area between holding racks 50 and leg tower 6. For example, should gap G exist, leg tower 6 may have a tendency to bend slightly in response to the bending moment highlighted in FIG. 10, and sloped surfaces 61 are configured to maximize the contact area between holding racks 50 and leg tower 6 in such a case. Although not shown, hydraulic holding rack actuators (described above) may be utilized in place of wedge-shaped holding rack actuators depicted in FIG. 11C.

As shown in FIG. 11D, which is a top view of one embodiment of one of the present rings, illustrates that ring 56 may be provided with rounded portions 77 arranged at roughly (or precisely) 90 degree angles with respect to racks 2. As used herein, a portion that is "rounded" need not have a perfectly arcuate shape; instead, it need only be slightly convex A "rounded" portion may, however, be spherically shaped. Should gap G exist, and should leg tower 6 (not shown) have a tendency to rock toward the holding rack beneath the gap, rounded portions 77 may facilitate that movement and, as a result, better ensure that the contact area between the leg tower and the holding rack(s) is maximized. FIG. 11E, which is a cross-sectional view of another embodiment of one of the present rings, illustrates that should more than two racks 2 be secured to a given leg, ring 56 may be provided with rounded portion 77 that extends around the entire top portion of the ring. In addition, FIG. 11E illustrates that sloped portion 61 may be provided around the remainder of the top surface of ring 56. In this embodiment, sloped portion 61 may be thought of as a portion of a cone. The ring depicted in FIG. 11E is capable or reacting to tilt in any direction to address a gap located above any of the present holding racks provided with the ring in order to better ensure that the contact area between the leg tower and the holding rack(s) is maximized. The present rounded portions provided on the present rings may be integrally formed with the rings, or they may be attached to the rings in any suitable fashion, including through welding, nuts and bolts, friction fit, interlocking parts, etc.

Figure 12:
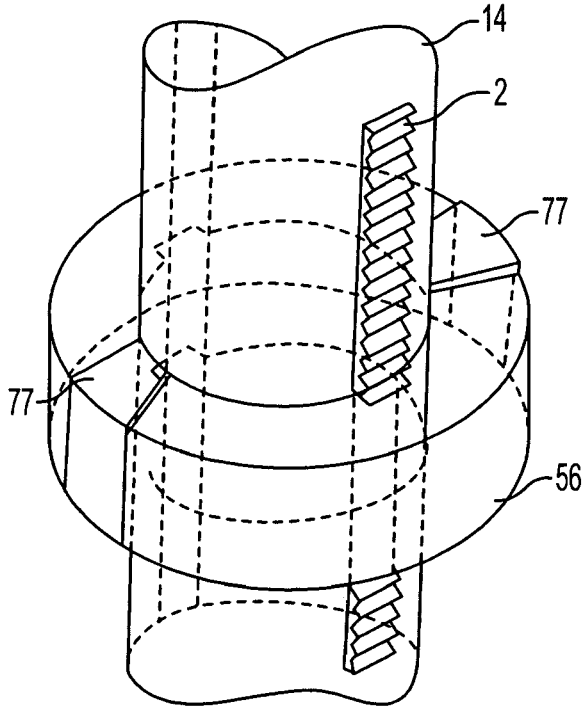
FIG. 12 is a perspective view of a ring similar to the one depicted in FIG. 11C.

The present rounded portions may also be raised slightly from the top surface of ring 56, as illustrated in FIG. 12, which depicts an embodiment of ring 56 in which the holding racks, which not visible due to their location, are engaging racks 2 secured to second leg 14.

Figure 15:
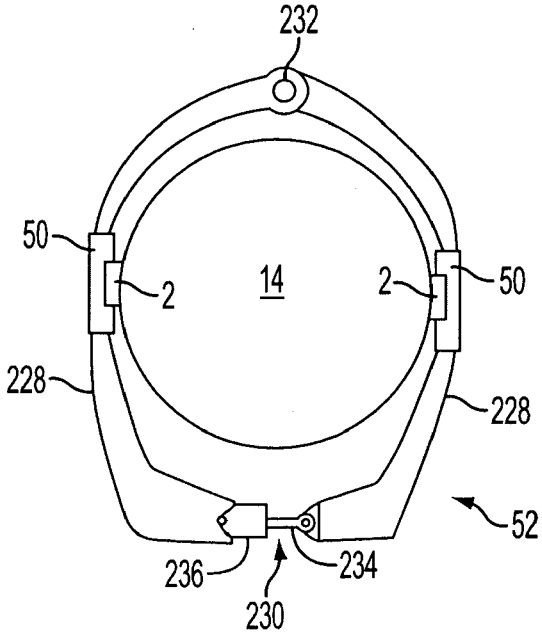
FIG. 15 is a top view of one embodiment of a holding rack actuator that includes two hinged arms and a hydraulic device.

FIG. 15 illustrates another embodiment of holding rack actuator 52. As shown, a single holding rack actuator may be configured to cause multiple (e.g., two, as shown in FIG. 15) holding racks to engage (or disengage) the racks secured to a given leg. FIG. 15 illustrates that holding rack actuator 52 may take the form of a clamp that includes, but is not limited to, arms 228, each arm being coupled to a holding rack 50. Arms 228 may be coupled to holding racks 50 by any suitable means, such as those disclosed herein relating to welding, nuts and bolts, and the like. As shown, arms 228 are secured in operative relation to each other using a pin (not shown), at location 232. Further, hydraulic device 230 (which, as shown, can consist of an arm 234 secured to one arm 228 and cylinder 236 secured to the other arm 228) coupled to both arms 228 may be operated to cause holding racks 50 to engage or disengage racks 2. Those of skill in the art having the benefit of this disclosure will understand that the controls for operating hydraulic device 230, as may the controls for any of the present hydraulic holding rack actuators, may be positioned in any suitable location, such as above the surface of the platform for easy access by an operator. Holding rack actuator 52 shown in FIG. 15 may be sufficiently secured to holding racks 50 that it need not be connected to either ring 56 (should a ring be used), or platform 10.

Figure 25:
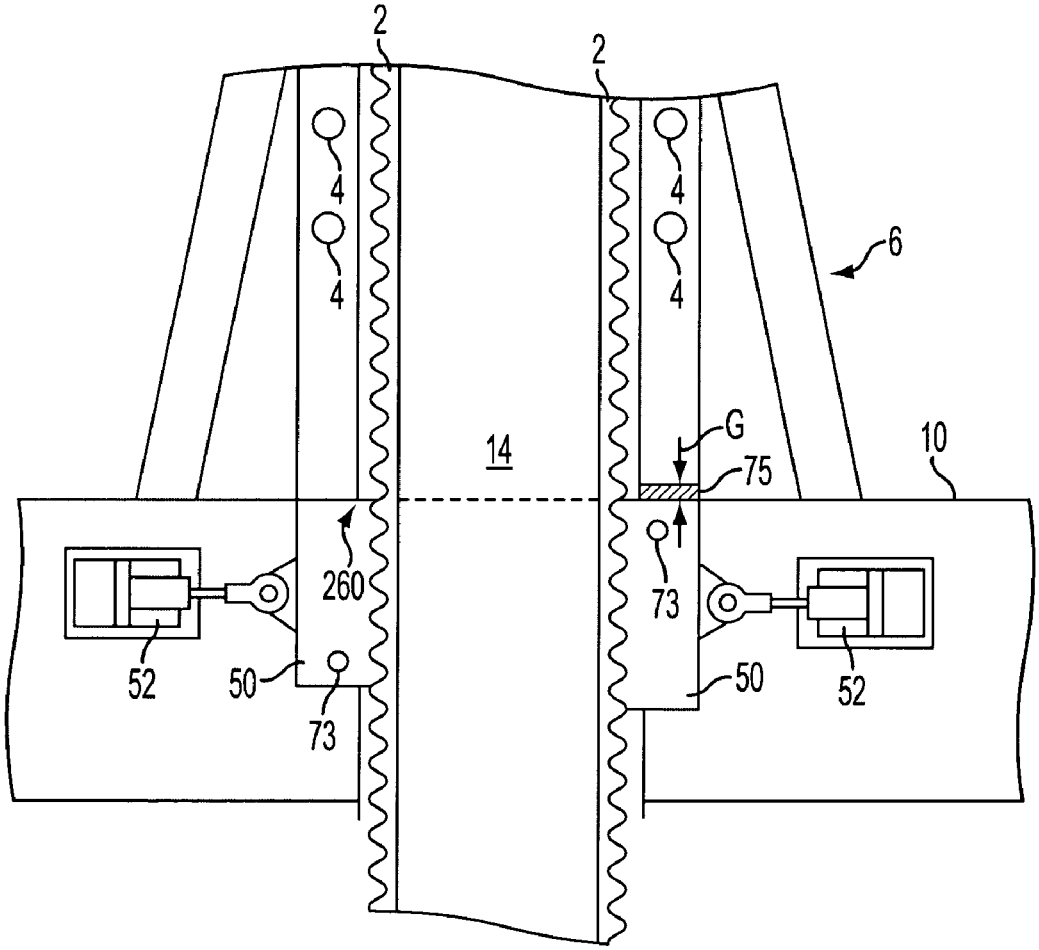
FIG. 25 is cross-sectional view without the hatching that depicts the use of the present holding racks in conjunction with a shim to stem the problems that may be associated with any gaps in the alignment of the racks secured to the leg shown.

As yet another alternative, one or more shims, which are simply structures designed to fill gap G, may be utilized. FIG. 25 is a cross-sectional view (without the hatching) that illustrates shim 75 being used to fill gap G such that the weight of platform 10 (and any cargoes thereon) acts equally (or substantially equally) on both holding racks 50. The present shim(s) may be utilized without ring 56 to address potential problems associated with gap G. The present shims may also be utilized with ring 56 to better address potential problems associated with gap G. In one embodiment, the present shims may be slightly wedge-shaped, thus having a slope. The present shims may be made from any suitable material, including metal.

FIG. 25 also illustrates holding racks 50, which are hinged about openings 73. Openings 73 are positioned such that the hinges about which holding racks 50 may rotate are positioned horizontally (or substantially horizontally). Openings 73 can be oversized holes that allow some play in the location of the holding racks with respect to the racks with which they can be engaged. In other words, by oversizing them, more flexibility in matching the teeth of the present holding racks with the grooves of the racks secured to the legs may be allowed. (As in FIG. 11A, the hinge pin that may be placed within opening 73 is not illustrated.) Such an oversized hole may help to eliminate gap G. FIG. 25 also illustrates that hydraulic holding rack actuators 52. The holding racks in FIG. 25, and throughout this specification, are not drawn to scale with respect to the depth of the platforms and size of the leg towers depicted in these figures. In this regard, it will be understood by those of skill in the art having the benefit of this disclosure that with proper tolerances and sizing considerations taken into account, the top edges of the present holding racks (e.g., edge 260 in FIG. 25) will not interfere with the bottom edges of the leg towers in question (e.g., leg tower 6 in FIG. 25).

One manner of using the present shims involves placing, or inserting, them after the platform has been raised to a desired height. Specifically, once a holding rack has been engaged, and the pinions are relieved partially or completely of their loads (i.e., one or more of the pinions are disengaged), the operator will be able to ascertain whether the platform (through the leg towers) is resting squarely on the holding rack in question. If it is not, he can reengage the pinions to lift the platform slightly. If the openings in the holding racks are oversized, the position of the holding rack will remain unchanged—to the extent of the oversizing—as the platform is raised, thereby exposing the gap in which the present shim or shims may be inserted. The platform may only need to be raised a fraction of an inch to expose the gap into which the shim may be wedged, or placed. This same general approach may be followed whether the platform is designed to come to rest on the present rings, which are discussed in greater detail below.

Figure 13:
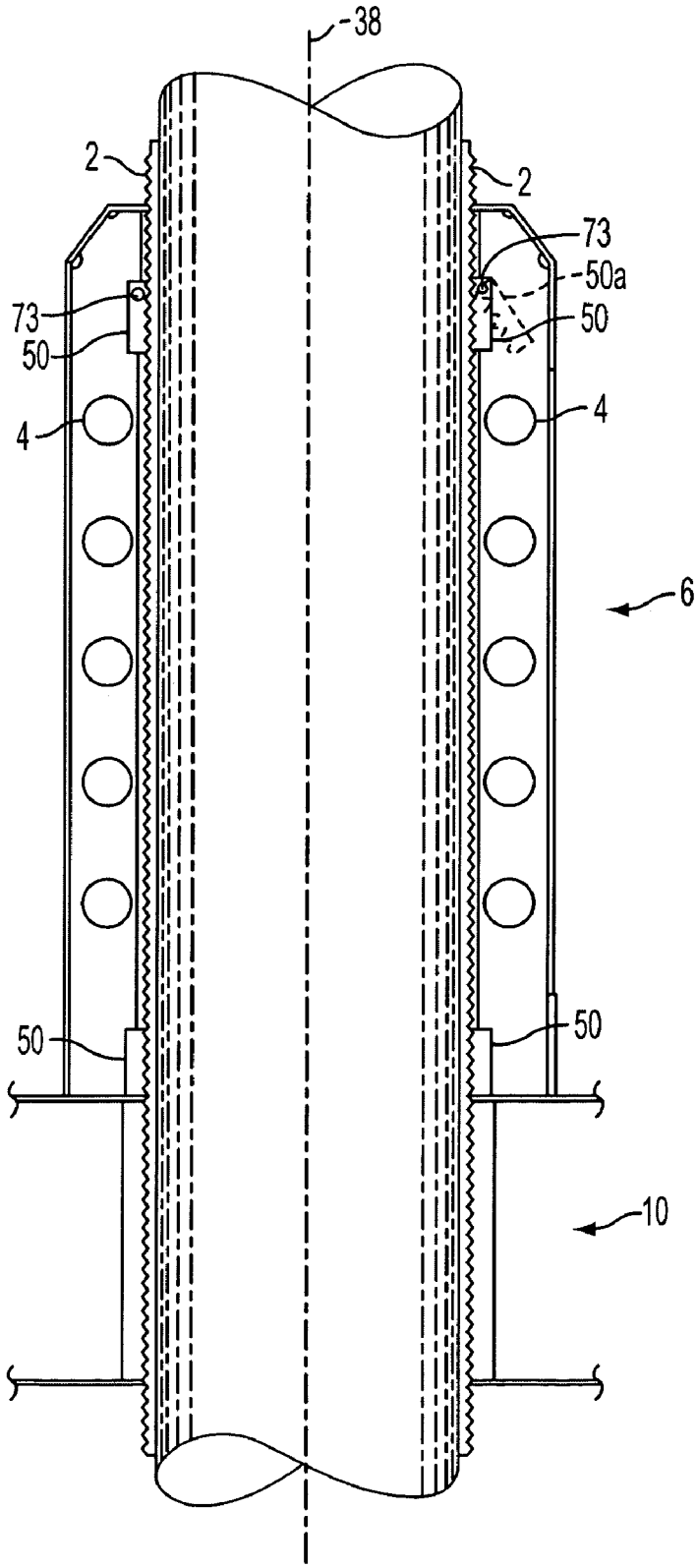
FIG. 13 is cross-sectional view without the hatching that depicts another embodiment of a system useful in maintaining the position of a platform, which system includes holding racks positioned above and below the upper and lower most pinions that are secured to a leg tower.

Still another alternative of a system that is useful in maintaining the position of a platform using one or more hinged holding racks is illustrated in FIG. 13. FIG. 13, which is a cross-sectional view without the hatching, illustrates a leg tower 6 having holding racks 50 and pinions 4. Holding racks 50 are configured to engage racks 2, which are secured to second leg 14. Platform 10 is coupled to second leg 14. FIG. 13 makes clear that a leg tower, rather than a platform, may contain the present holding racks. FIG. 13 illustrates that the uppermost holding racks 50 on either side of second leg 14 have openings 73 and are therefore hinged, as described above. No matter how they are implemented, the present holding racks may be hinged.

By decreasing the distance between a holding rack and the nearest driving pinion, the likelihood that a gap G will be encountered may be lessened. The present holding racks may be used at any location along a leg tower—i.e., above the highest pinion and below the lowest pinion (as illustrated in FIG. 13); solely above the highest pinion; solely above the lowest pinion; above the highest pinion, below the lowest pinion, and intermittent one or more of the pinions; only intermittent one or more pinions. Further, when the holding rack or racks are hinged, the hinge may be positioned horizontally or vertically. When horizontally positioned, the opening in which the hinge is located may be positioned such that the bottom of the hinged holding rack rotates away from the rack it is configured to engage (as illustrated by holding rack 50*a* in FIG. 13), or such that the top of the hinged holding rack rotates away from the rack it is configured to engage (not shown). Similarly, when the opening within a holding rack is positioned vertically, it may be positioned at either side of the holding rack such that the opposite side of the holding rack will swing away from the rack secured to the leg.

Figure 14:
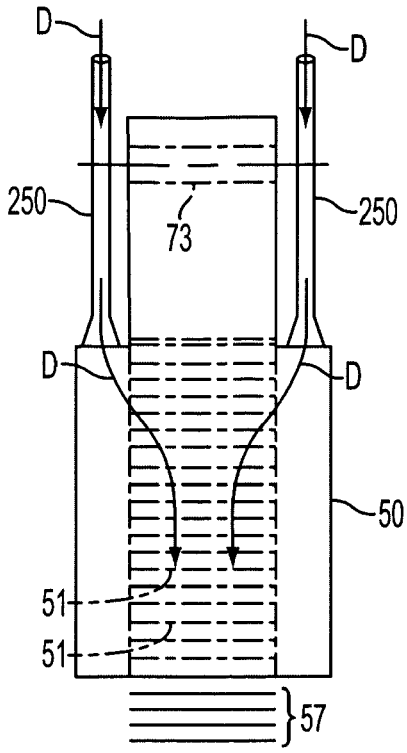
FIG. 14 is a back, or rear, view of one of the present holding racks engaged with a rack (the rack is not shown); the view illustrates the distribution of weight from the platform through the holding rack and throughout the relevant leg (also not shown)

FIG. 14 shows a view of the back of hinged holding rack 50 having opening 73. Arrows D represent the direction in which the weight of the platform and its cargoes is distributed through holding rack 50 en route to being carried by the relevant leg. Dashed lines 51 represent the distribution of that weight throughout holding rack 50, and solid lines 57 represent the distribution of that weight throughout the relevant leg (not shown). The vertically oriented support bars 250 may be portions of leg tower 6, to which any of the present holding racks may be secured. The weight transfer of the platform and its cargoes to the legs through the holding racks may be achieved as follows: The pinions secured to the leg towers may raise or lower the platform to a desired height; the present holding racks may engage the racks secured to the legs (also described herein as the "driving racks") through operation of the present holding rack actuators; one or more of the pinions may be disengaged from the driving racks; and weight D may flow through, for example, holding rack 50 illustrated in FIG. 14 to the relevant leg as illustrated by the arrows in FIG. 14.

Figure 26:
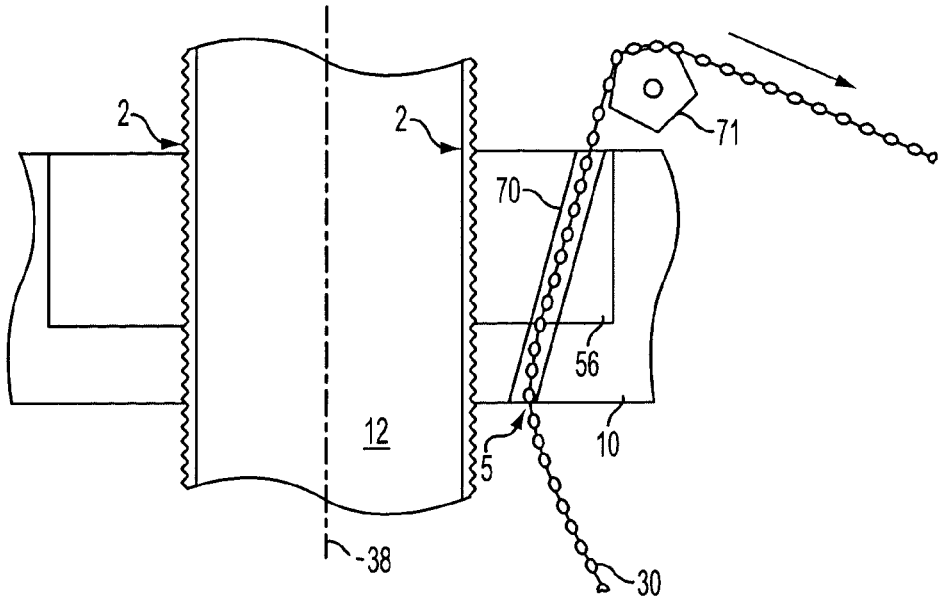
FIG. 26 is cross-sectional view without the hatching that depicts one of the present braces extending through one of the present rings to a wildcat.

The present anchoring structures may include the present rings. Additionally, the term "coupled" with respect to a brace that is "coupled" to an anchoring structure that includes, for example, a ring or a ring having a holding rack has the same meaning as the term "coupled" with respect to braces that are "coupled" to legs. FIG. 26 illustrates one embodiment of a brace (brace 30) that is coupled to an anchoring structure that includes platform 10. Ring 56, which has holding racks that are not illustrated, rests within a recess in platform 10. Thus, the brace arrangement depicted in FIG. 26 may be described as brace 30 being coupled to an anchoring structure at second location 5 that includes platform 10. The brace arrangement depicted in FIG. 26 may also be described as brace 30 being coupled to an anchoring structure at second location 5 that includes ring 56. As illustrated in FIG. 26, brace 30 is coupled to platform 10 through passageway 70 (which may be effected through the use of a hawse pipe) that is provided in both ring 56 and platform 10. A hawse pipe is well known reinforced pipe through which any of the present braces may be led. Those of skill in the art having the benefit of this disclosure will understand how to place a hawse pipe within ring 56 and platform 10 to create passageway 70. Thus, the brace arrangement depicted in FIG. 26 may also be described as brace 30 being coupled to an anchoring structure at second location 5 within an opening provided in platform 10. Brace 30 extends through passageway 70 and may be secured to a winch 71 (which may include a wildcat connected to a winch), illustrated very simplistically in FIG. 26. The arrow above brace 30, which is illustrated as a chain, indicates that excess brace material may be directed to any suitable storage area, such as a chain locker. The chain locker may be located on top of, or within a recess located in, platform 10. Although not illustrated, those of skill in the art having the benefit of this disclosure will understand that second location 5 may be positioned at the top edge of the opening in ring 56.

As discussed above, ring 56 may be loosely contained within a recess (e.g., recess 200 in FIG. 11C) that is built into platform 10. The weight of ring 56 should normally suffice to ensure its stability within a recess in platform 10, however any suitable means of securing ring 56 to platform 10 may be used in this regard, including nuts and bolts, clamps, welds, and the like. In operation, ring 56 will be effectively secured to a leg when the holding racks of the ring are engaged with the racks secured to the leg. The pinions may then be actuated to best ensure that the weight of platform 10 (through leg towers 6) rests on ring 56.

The braces that may be used as part of the systems that are useful in stabilizing vessels may be rigid. As used herein, a brace that is "rigid" is relatively stiff and inflexible. These braces may also be flexible. As used herein, a brace that is "flexible" may be bent without necessarily deforming it plastically, i.e., such that its usefulness after bending is not substantially compromised. The present braces may include multiple loops that are linked together, such as a chain. The present braces may also include wire rope. The present braces may also be formed from pieces of different braces, and still be braces consistent with this disclosure.

Figure 20A:
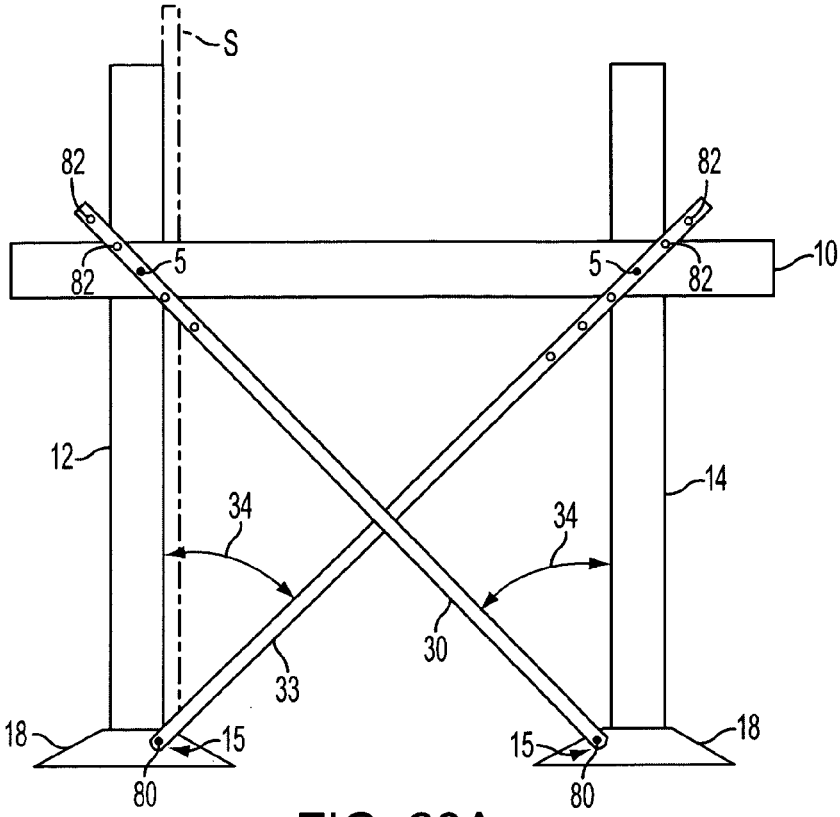
FIG. 20A depicts one embodiment of a system useful in stabilizing a vessel that includes two of the present rigid braces.

Turning to the issue of the manner in which rigid braces may be utilized consistently with the present systems and methods, FIG. 20A illustrates one embodiment of a system useful in stabilizing a vessel, which vessel includes platform 10, first leg 12, second leg 14, both of which are coupled to platform 10, and footing structures 18 coupled to each of the legs. Braces 30 and 33 illustrated in FIG. 20A are rigid, and may be stored when not in use, as shown by position S with respect to brace 33. When in use, braces 33 and 30 may be rotated about pins 80, which may be used in coupling the braces to first leg 12 and second leg 14, respectively. The opening within the braces in which the pins may be placed may be enlarged (as with openings 73 discussed above) to allow the braces to rotate about the pins such that more than one axis of rotation is possible. Alternatively, and by way of example, a universal joint may be utilized in place of pins 80 to allow the braces a range of motion about at least 2 axes. Further, those of skill in the art having the benefit of this disclosure will understand that any suitable means of coupling the rigid braces to the legs may be utilized.

As shown in FIG. 20A, braces 33 and 30 may be provided with multiple openings 82 through which pins may be placed in order to couple the braces to anchoring structures, such as platform 10 in this embodiment. As shown, both braces form acute angles 34 with the legs to which they are coupled. The relevant portion of platform 10, or of a structure connected to platform 10, may be provided with openings through which the same pin may be placed. The openings may be placed at any convenient interval, such as, for example, 2 feet. The present rigid braces may be formed from any suitable material, such as metal. In one embodiment, the present rigid braces may be made of twelve inch diameter steel pipe. In another embodiment, the steel pipe may be eighteen inches in diameter. In yet another embodiment, four inch round steel bars may be used. These dimensions are exemplary only.

From one to an unlimited number of pins may be used in this fashion to secure a rigid brace to an anchoring structure such as a platform. The pins that may be placed through openings 82, as well as pins 80, may be, for example, one, two, or three inches in diameter, as needed. Although not illustrated in FIG. 20A, the present rigid braces may be configured as telescoping structures, such that the amount of overhang beyond platform 10 is reduced. Thus, braces 30 and 33 are shown in FIG. 20A as being coupled to second leg 14 and first leg 12, respectively at first locations 15 along the braces; the braces are also coupled to anchoring structures, both of which include platform 10 in this embodiment, at second locations 5 along the braces.

In an effort to provide the reader with more information about the characteristics of conventional vessels in contrast to the present vessels, the inventor provides the following. To the inventor's knowledge, the tallest legs constructed for use have been 250 feet high. Further, a conventional vessel having such three legs may have the following dimensions: platform length—140 feet; platform breadth—90 feet; platform depth—12 feet; platform draft (which is the dimension extending from the bottom of the platform to the level of the water in which the platform is floating when in transit and the legs are raised)—9 feet; leg length—250 feet; leg diameter—78 inches; leg wall thickness—1½ inches. Using the present systems to stabilize a vessel, the following may be achieved when grip exists in each of the three legs used: platform length—135 feet; platform breadth—80 feet; platform depth—10 feet; platform draft—8 feet; leg length—300 feet; leg diameter—72 inches; leg wall thickness—¾ inches. A vessel with these dimensions may be achieved using, for example, the 6 brace setup depicted in FIG. 21F using 2 inch chain braces, or 4 inch round bar rigid braces, 12 inch diameter and ½ inch wall thickness rigid braces. Forty thousand pounds of tension should be maintained in each of the braces in this example to achieve the foregoing. The footing structures depicted in FIG. 29 may also be used with the present systems, and the pins placed through the legs in such a case may be 6 inches in diameter. Using the present systems when no grip exists with respect to any of the legs, the following values for the vessel just described may be achieve using, for example, 2 and ⅜ inch chain and legs that are 72 inches in diameter with ⅝ inch leg wall thicknesses.

Figure 20B:
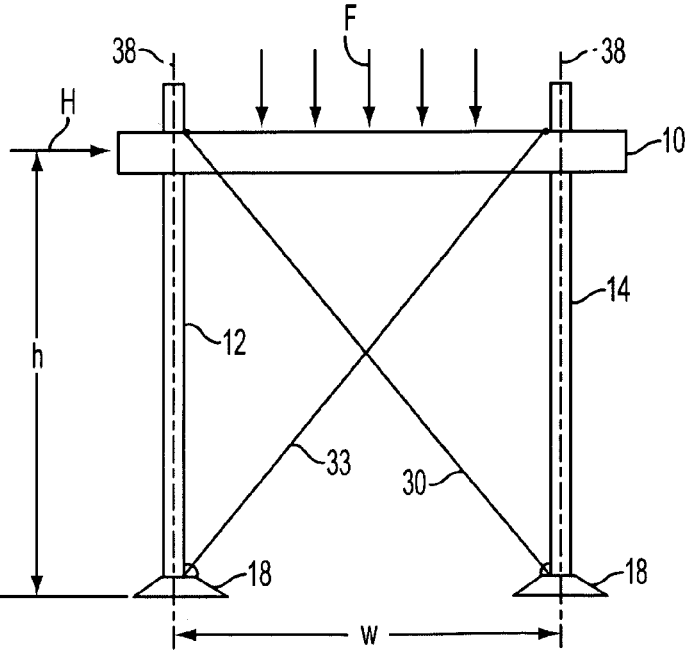
FIG. 20B depicts a view illustrating the different forces that may bear on one of the present vessels, and the values that may be utilized in sizing the legs to be used with the present vessels.

As further guidance for sizing the present systems useful for stabilizing vessels, turn to FIG. 20B, which depicts a rear view of one of the present vessels, including platform 10, first and second legs 12 and 14, which are coupled to platform 10, brace 30 coupled to second leg 14 and brace 33 coupled to first leg 12. Full load F is represented as a series of arrows acting downwardly, and horizontal force H, which is generically representative of any and all environmental forces, is acting in the direction indicated by the arrow beneath it. With the foregoing in mind, the sectional area, A, of braces 30 and 33 may be determined, for example, by designing the braces to resist side-sway buckling using the following formula:

$$A = \frac{F * \left[1 + \left(\frac{w}{h}\right)^2\right]^{\frac{3}{2}}}{\left(\frac{w}{h}\right)^2 E}; \quad \text{[Equation 1]}$$

where:

F represents the full load, which in FIG. 20B is distributed equally over first and second legs 12 and 14, respectively (in other words, half of F may be thought of as bearing on first leg 12 and the other half on second leg 14);

w represents the distance between centerlines 38 of the legs;

h represents the distances between horizontal force H and the effective bottom of the legs, which is the bottom of footing structures 18 (see FIG. 20B); and E is Young's modulus.

Another manner of ascertaining the sectional area, A, of braces 30 and 33 is to size the braces to withstand tension in the diagonals imparted by force H. As a general rule, the sectional area of the present braces is in the range of five to ten percent of the sectional area of the legs.

To further aid in the stabilization of a given vessel, multiple braces may be attached to one or more of the legs of the vessel. In this regard, as many braces as desired may be attached to any given leg. For example, although not shown in FIG. 2, it will be understood to those of skill of the art having the benefit of this disclosure that a second brace may be coupled to second leg 14. Like brace 30 depicted in FIG. 2, such a second brace may be coupled to second leg 14 at a first location along the second brace, and the second brace may form an acute angle with the first leg. Such a second brace may be coupled to an anchoring structure at a second location along the second brace. Such an anchoring structure may be the anchoring structure to which brace 30 is coupled. Further, the first and second locations along the second brace may define a second brace length between them, and at least a portion of such a second brace length may be located beneath the platform. Such a second brace may be coupled to second leg 14 through a footing structure that is located between the second brace and second leg 14, which footing structure may be the same footing structure to which brace 30 may be coupled (see FIG. 4). Such a footing structure may be coupled to one end of second leg 14.

As a further example, although not illustrated in FIG. 2, it will be understood by those skilled in the art having the benefit of this disclosure that a third brace may be coupled to second leg 14. Like brace 30 depicted in FIG. 2, such a third brace may be coupled to second leg 14 at a first location along the third brace, and the third brace may form an acute angle with the first leg. Such a third brace may be coupled to an anchoring structure at a second location along the third brace. Such an anchoring structure may be the anchoring structure to which the second brace described above may be coupled. Further, the first and second locations along the third brace may define a third brace length between them, and at least a portion of such a third brace length may be located beneath the platform. Such a third brace may be coupled to second leg 14 through a footing structure that is located between the third brace and second leg 14, which footing structure may be the same footing structure to which brace 30, and the second brace described above, may be coupled (see FIG. 4). Such a footing structure may be coupled to one end of second leg 14.

As yet a further example, although not illustrated in FIG. 2, it will be understood by those skilled in the art having the benefit of this disclosure that a fourth brace, like brace 30 and the second and third braces described above, may be coupled to second leg 14. Like brace 30 depicted in FIG. 2, such a fourth brace may be coupled to second leg 14 at a first location along the fourth brace, and the fourth brace may form an acute angle with the first leg. Such a fourth brace may be coupled to an anchoring structure at a second location along the fourth brace. Such an anchoring structure may be the anchoring structure to which the second and third braces described above may be coupled. Further, the first and second locations along the fourth brace may define a fourth brace length between them, and at least a portion of such a fourth brace length may be located beneath the platform. Such a fourth brace may be coupled to second leg 14 through a footing structure that is located between the fourth brace and second leg 14, which footing structure may be the same footing structure to which brace 30, and the second and third braces described above, may be coupled (see FIG. 4). Such a footing structure may be coupled to one end of second leg 14.

Although it is not illustrated in FIG. 2, those of skill in the art having the benefit of this disclosure will understand that a fifth, a sixth, a seventh, an eight, a ninth, a tenth, or even more braces may also be coupled to second leg 14, or any of the legs of the vessel. In this regard, each such brace may be coupled to a leg at a first location along the brace, and the brace may form an acute angle with the leg to which it is coupled (i.e., its respective leg). Each such brace may be coupled to an anchoring structure at a second location along the brace. Such an anchoring structure may be the anchoring structure to which one or more other braces may also be coupled. Further, the first and second locations along each such brace may define a brace length between them, and at least a portion of such a brace length may be located beneath the platform. Each such brace may be coupled to a through a footing structure that is located between the brace and the leg, which footing structure may be the same footing structure to which one or more other braces may be coupled. Such a footing structure may be coupled to one end of the leg to which the brace in question is coupled. These anchoring structures, as with all anchoring structures described herein, may be any of those structures described above, such as other legs, wildcats, etc.

Figure 16:
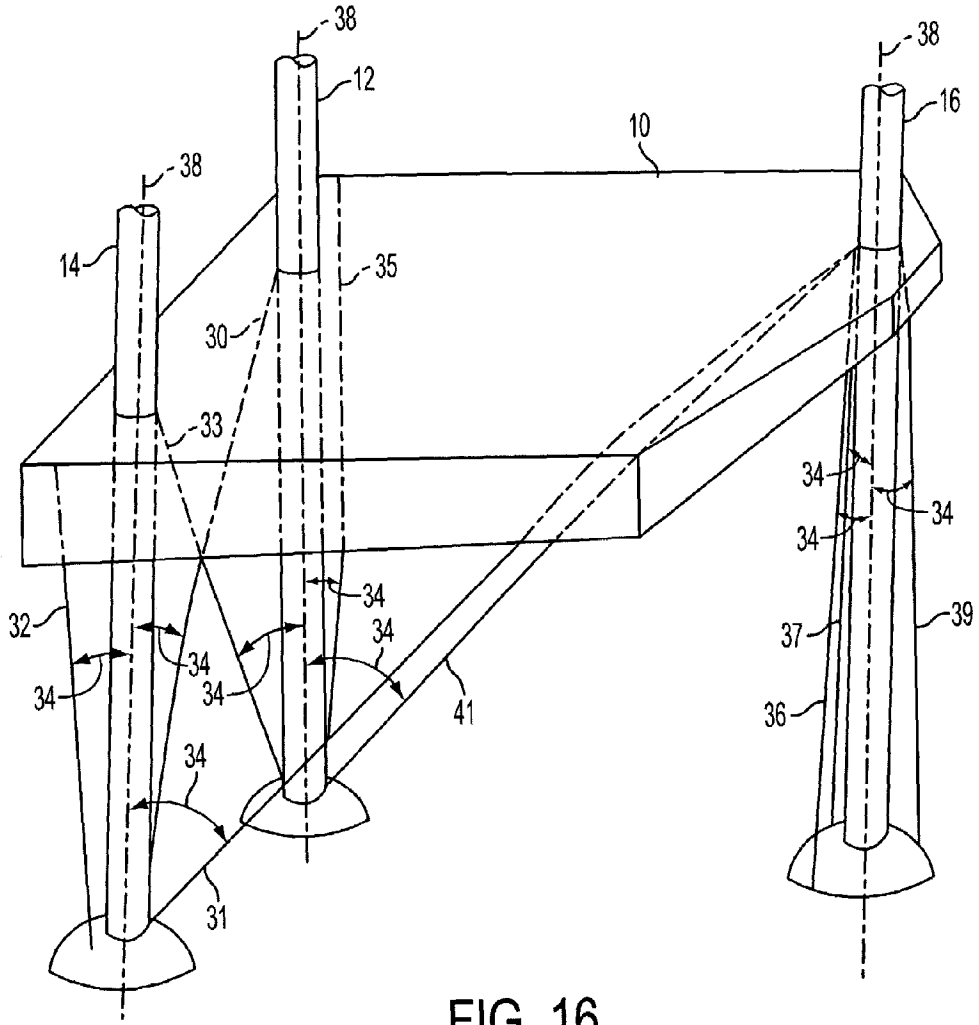
FIG. 16 depicts an embodiment of the present systems that are useful in stabilizing vessels, which embodiment includes three braces coupled to each of the three legs shown.

FIG. 16 depicts another embodiment of the present systems that are useful in stabilizing vessels such liftboats. FIG. 16 depicts a perspective view of a vessel that includes platform 10, first leg 12, second leg 14, and third leg 16, all three legs being coupled to platform 10. Each leg has a centerline 38. As depicted, three braces are coupled to each of the legs. Specifically, braces 30, 31, and 32 are coupled to second leg 14; braces 33, 41, and 35 are coupled to first leg 12; and braces 36, 37, and 39 are coupled to third leg 16. Each brace forms an acute angle 34 with the leg to which it is coupled, and more specifically with the centerline 38 of the leg to which it is coupled. It will be understood to those of skill in the art having the benefit of this disclosure that, although they are not depicted in FIG. 16 for ease of viewing, each of the braces depicted in FIG. 16—as does every brace (rigid or flexible) described herein as being connected to a leg—has a brace length comparable to the brace length depicted along brace 30 in FIG. 2, and at least a portion of that brace length (also not labeled in FIG. 16 for ease of viewing) is located beneath platform 10. Further, each brace in FIG. 16 is coupled to an anchoring structure, and one or more of those anchoring structures may be same. (The details of the connections between the braces and anchoring structures are not illustrated in FIG. 16 for ease of viewing). Additionally, although not illustrated in FIG. 16 for ease of viewing, it will be understood to those of skill in the art having the benefit of this disclosure that in cases in which the braces depicted in FIG. 16 are flexible (and this is the case with each flexible brace disclosed herein), excess brace material that exists above the location at which the brace is coupled to an anchoring structure or a leg may be stored in any suitable location, such as a chain locker. Alternatively, the same excess material may be secured in any suitable fashion to the nearest leg of the vessel by, for example, running it along the leg in lengthwise fashion. As shown in FIG. 16, each brace is coupled to a leg through a footing structure, which footing structure is coupled to one end of its respective leg. Certain of the footing structures are the same, such as the ones to which braces 36, 37, and 39 are coupled.

FIG. 16 illustrates only one embodiment of a one of the present systems that is useful in stabilizing a vessel such as a liftboat. Accordingly, those of skill in the art will, with the benefit of this disclosure, understand that additional braces may be coupled to each of the legs illustrated in FIG. 16 consistent with this disclosure. As a result, each leg depicted in FIG. 16 could have four, five, six, seven, eight, nine, ten, or more braces coupled to it. Similarly, those of skill in art will, with the benefit of this disclosure, understand that more than three legs may be coupled to platform 10, and that each of those additional legs may have ten or more braces coupled to them, each brace having the same attributes of the braces described herein, including such attributes as brace portions nearest the leg in question, etc.

Figure 17:
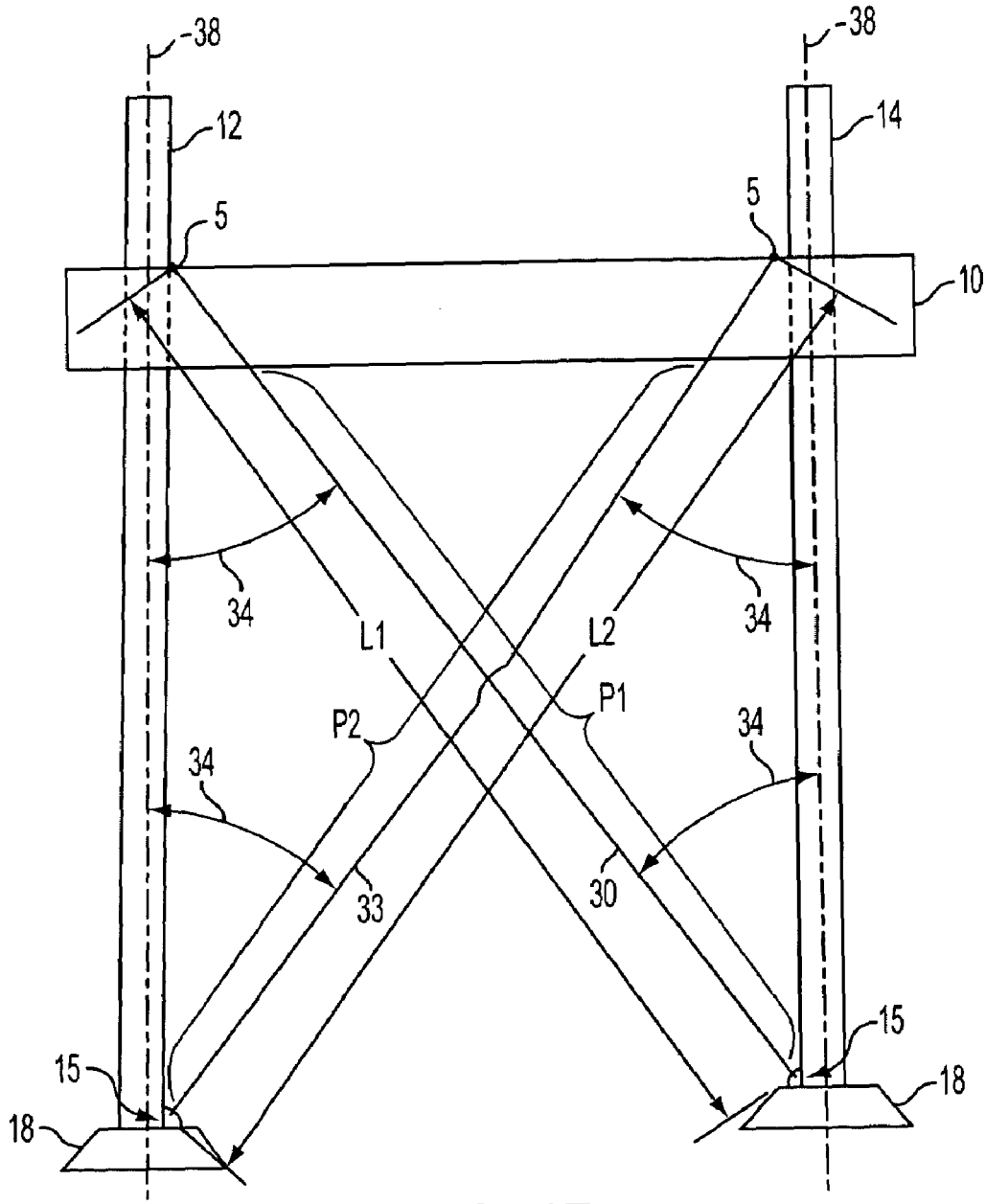
FIG. 17 is a rear view of one of the present vessels that includes a brace coupled to each leg shown the footing structure coupled to that leg.

Furthermore, it will be understood to those of skill in the art having the benefit of this disclosure that regardless of the number of legs coupled to a given platform, each such leg may have as few as one or two braces coupled to it in the manner described herein. One illustration of the situation in which only two braces are coupled to a given leg is FIG. 17, which shows braces 30 and 33 being coupled to first leg 12. In FIG. 17, the anchoring structure to which brace 30 is coupled includes first leg 12. Brace 30 is coupled to second leg 14 at a first location 15 along brace 30, and brace 30 is coupled to an anchoring structure, which includes first leg 12, at a second location 5 along brace 30, the two locations defining a first brace length L1 therebetween. In addition, at least a portion P1 of first brace length L1 is located beneath platform 10. Brace 33 is coupled to first leg 12 at a first location 15 along brace 33, and brace 33 is coupled to an anchoring structure at a second location 5 along brace 33, the two locations defining a second brace length L2 therebetween. In addition, at least a portion P2 of second brace length L2 is located beneath platform 10. As illustrated, both braces 30 and 33 are oriented at acute angles with both first leg 12 and with second leg 14, and more particularly with the centerlines 38 of those legs. A footing structure 18 is coupled to each of first leg 12 and second leg 14. Further, as illustrated, the braces in FIG. 17 are coupled to the legs at first locations 15 through the footing structures, which may be described as being between the brace and the leg to which it is coupled.

Figure 18:
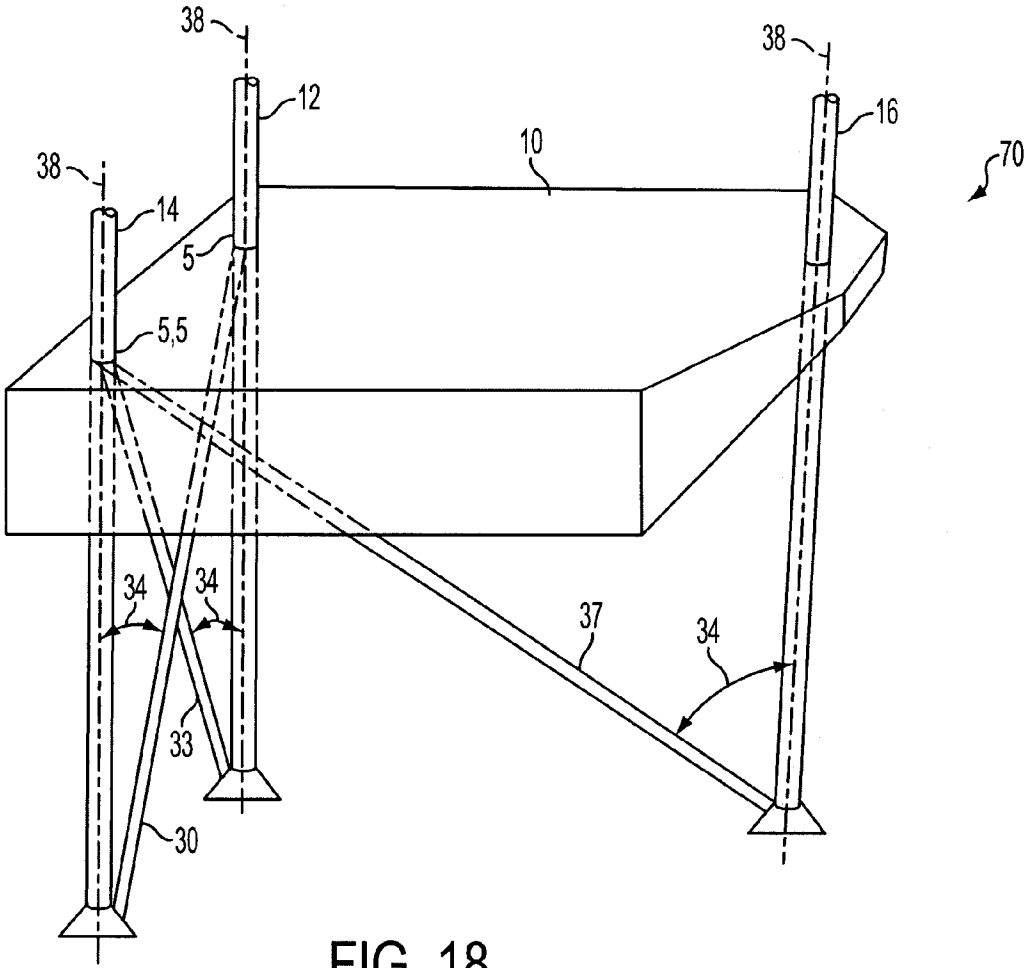
FIG. 18 depicts one embodiment of the present vessels.

Although the invention has been described as systems that are useful in stabilizing vessels, and as systems that are useful in stabilizing platforms, the present invention may also be characterized as a vessel. FIG. 18 depicts vessel 70, which includes platform 10, first leg 12, second leg 14, and third leg 16, all of which are coupled to platform 10. Vessel 70 also includes flexible braces 30, 33, and 37, which are coupled to second leg 14, first leg 12, and third leg 37, respectively, and which flexible braces are oriented at acute angles with the same respective legs, and more particularly with the centerlines 18 of those respective legs. The flexible braces depicted in FIG. 18 have the same brace lengths and portions of brace lengths positioned beneath platform 10 as the other braces disclosed herein. These aspects of the braces are simply not illustrated for ease of viewing. Further, each flexible brace is coupled to an anchoring structure in any of the manners described herein.

In operation, the present systems and methods (the methods will be discussed below in more detail) are useful in stabilizing both platforms and vessels with platforms that may be raised or lowered along legs. The tendency of the legs of a conventional vessel to buckle is generally considered to be of utmost concern to designers. The tendency of a leg to buckle, T, may be expressed by $$\frac{Kl}{r},$$

where:

K represents the ratio of the effective length of a leg to the actual length of the leg;

l is the actual length of the leg; and r is the radius of gyration of the leg.

Figure 19:
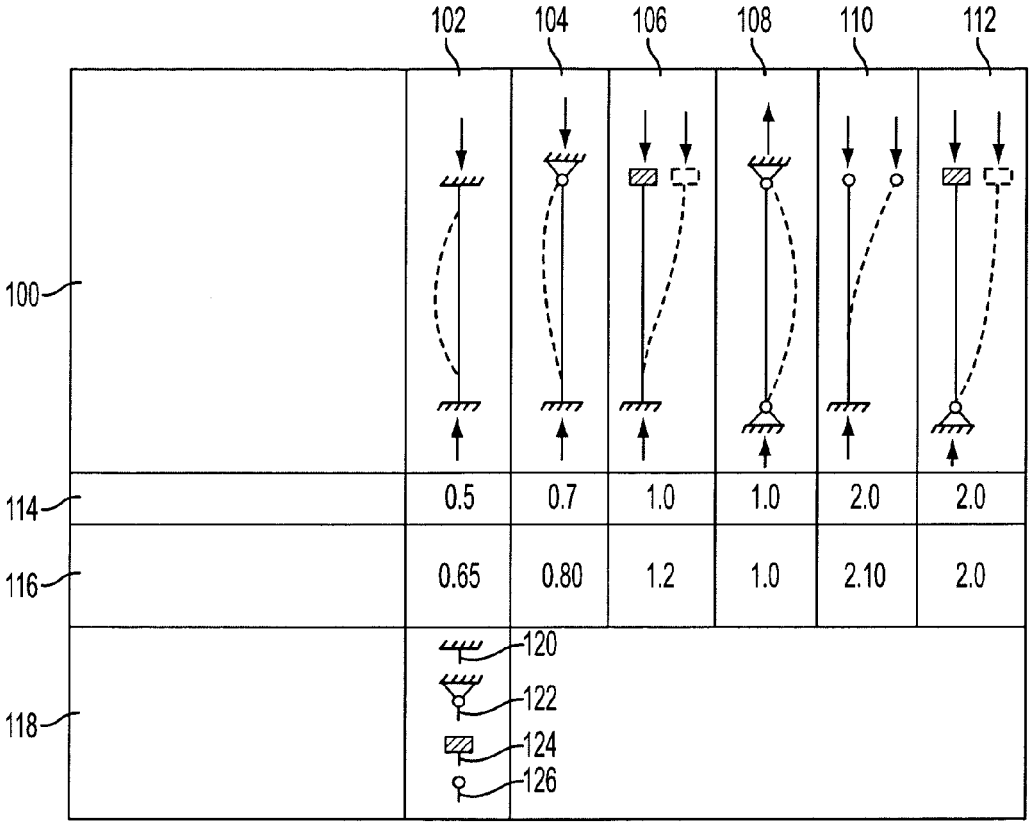
FIG. 19 is a table of various variables that affect K values for different conditions.

The value of $$\frac{l}{r}$$

is also known as the slenderness ratio. FIG. 19 contains a row of theoretical K values 114 for certain conditions 102, 104, 106, 108, 110, and 112. The row in FIG. 19 represented by element 100 indicates that the buckled shape of the column illustrated in conditions 102-112 is shown by a dashed line. The row in FIG. 19 represented by element 118 is the end condition code, and illustrates that the symbol represented by element 120 represents fixed rotation and fixed translation; that the symbol represented by element 122 represents free rotation and free translation; that the symbol represented by element 124 represents fixed rotation and free translation; and that the symbol represented by element 126 represents free rotation and free translation. The row in FIG. 19 represented by element 116 is the recommended design value when ideal conditions are approximated. The radius of gyration, r, of a leg is proportional to the diameter of the cylinder (in cases in which metal tubes are used as legs) or the dimensions of the triangle or rectangular sections (of a leg that includes trusses), and it will generally represent the lateral dimension(s) of a leg against the length of the leg. In this regard, the length referred to is brace length L1, described below in more detail.

As illustrated in FIG. 19, the K value corresponding to conditions 110 and 112 is 2.0. This K value is representative of the K value for the legs of traditional vessels because those legs are capable of the lateral movement described by conditions 110 and 112. Further, the distance between the legs of a conventional vessel, as well as of the present vessels disclosed herein, is usually much larger than the radius of gyration of any one of the legs. Since use of the present braces in the present systems prevents the shifting depicted by conditions 110 and 112, use of the present braces in the present systems brings the value of K to unity and may result in reducing the value of Equation 1 for a given leg from 160 to 80 [See Manual of Steel Construction, Section 1.8, Eighth Ed., American Institute of Steel Construction, Inc., 1980 ]. In other words, use of the present braces in the present systems may bring about the condition described by 106 or 108. Consequently, the allowable compressive stress that may be placed on the leg in question, $F_a$, more than doubles, as may be seen below in Table 1 (compare $F_a$ value of Main and Secondary Members with a $$\frac{Kl}{r}$$

value not over 120 having a $$\frac{Kl}{r}$$

of 80 with the $F_a$ value of Main Members with a $$\frac{Kl}{r}$$

value of 121 to 200 having a $$\frac{Kl}{r}$$

value of 160):

TABLE 1

| Main and Secondary Members K1/r not over 120 | | | | | | Main Members K1/r 121 to 200 | | | |
|---|---|---|---|---|---|---|---|---|---|
| $\frac{Kl}{r}$ | $F_a$ (ksi) | $\frac{Kl}{r}$ | $F_a$ (ksi) | $\frac{Kl}{r}$ | $F_a$ (ksi) | $\frac{Kl}{r}$ | $F_a$ (ksi) | $\frac{Kl}{r}$ | $F_a$ (ksi) |
| 1 | 21.56 | 41 | 19.11 | 81 | 15.24 | 121 | 10.14 | 161 | 5.76 |
| 2 | 21.52 | 42 | 19.03 | 82 | 15.13 | 122 | 9.99 | 162 | 5.69 |
| 3 | 21.48 | 43 | 18.95 | 83 | 15.02 | 123 | 9.85 | 163 | 5.62 |
| 4 | 21.44 | 44 | 18.86 | 84 | 14.90 | 124 | 9.70 | 164 | 5.55 |
| 5 | 21.39 | 45 | 18.78 | 85 | 14.79 | 125 | 9.55 | 165 | 5.49 |
| 6 | 21.35 | 46 | 18.70 | 86 | 14.67 | 126 | 9.41 | 166 | 5.42 |
| 7 | 21.30 | 47 | 18.61 | 87 | 14.56 | 127 | 9.26 | 167 | 5.35 |
| 8 | 21.25 | 48 | 18.53 | 88 | 14.44 | 128 | 9.11 | 168 | 5.29 |
| 9 | 21.21 | 49 | 18.44 | 89 | 14.32 | 129 | 8.97 | 169 | 5.23 |

TABLE 1-continued

| Main and Secondary Members K1/r not over 120 | | | | | | Main Members K1/r 121 to 200 | | | |
|---|---|---|---|---|---|---|---|---|---|
| $\frac{Kl}{r}$ | $F_a$ (ksi) | $\frac{Kl}{r}$ | $F_a$ (ksi) | $\frac{Kl}{r}$ | $F_a$ (ksi) | $\frac{Kl}{r}$ | $F_a$ (ksi) | $\frac{Kl}{r}$ | $F_a$ (ksi) |
| 10 | 21.16 | 50 | 18.35 | 90 | 14.20 | 130 | 8.84 | 170 | 5.17 |
| 11 | 21.10 | 51 | 18.26 | 91 | 14.09 | 131 | 8.70 | 171 | 5.11 |
| 12 | 21.05 | 52 | 18.17 | 92 | 13.97 | 132 | 8.57 | 172 | 5.05 |
| 13 | 21.00 | 53 | 18.08 | 93 | 13.84 | 133 | 8.44 | 173 | 4.99 |
| 14 | 20.95 | 54 | 17.99 | 94 | 13.72 | 134 | 8.32 | 174 | 4.93 |
| 15 | 20.89 | 55 | 17.90 | 95 | 13.60 | 135 | 8.19 | 175 | 4.88 |
| 16 | 20.83 | 56 | 17.81 | 96 | 13.48 | 136 | 8.07 | 176 | 4.82 |
| 17 | 20.78 | 57 | 17.71 | 97 | 13.35 | 137 | 7.96 | 177 | 4.77 |
| 18 | 20.72 | 58 | 17.62 | 98 | 13.23 | 138 | 7.84 | 178 | 4.71 |
| 19 | 20.66 | 59 | 17.53 | 99 | 13.10 | 139 | 7.73 | 179 | 4.66 |
| 20 | 20.60 | 60 | 17.43 | 100 | 12.98 | 140 | 7.62 | 180 | 4.61 |
| 21 | 20.54 | 61 | 17.33 | 101 | 12.85 | 141 | 7.51 | 181 | 4.56 |
| 22 | 20.48 | 62 | 17.24 | 102 | 12.72 | 142 | 7.41 | 182 | 4.51 |
| 23 | 20.41 | 63 | 17.14 | 103 | 12.59 | 143 | 7.30 | 183 | 4.46 |
| 24 | 20.35 | 64 | 17.04 | 104 | 12.47 | 144 | 7.20 | 184 | 4.41 |
| 25 | 20.28 | 65 | 16.94 | 105 | 12.33 | 145 | 7.10 | 185 | 4.36 |
| 26 | 20.22 | 66 | 16.84 | 106 | 12.20 | 146 | 7.01 | 186 | 4.32 |
| 27 | 20.15 | 67 | 16.74 | 107 | 12.07 | 147 | 6.91 | 187 | 4.27 |
| 28 | 20.08 | 68 | 16.64 | 108 | 11.94 | 148 | 6.82 | 188 | 4.23 |
| 29 | 20.01 | 69 | 16.53 | 109 | 11.81 | 149 | 6.73 | 189 | 4.18 |
| 30 | 19.94 | 70 | 16.43 | 110 | 11.67 | 150 | 6.64 | 190 | 4.14 |
| 31 | 19.87 | 71 | 16.33 | 111 | 11.54 | 151 | 6.55 | 191 | 4.09 |
| 32 | 19.80 | 72 | 16.22 | 112 | 11.40 | 152 | 6.46 | 192 | 4.05 |
| 33 | 19.73 | 73 | 16.12 | 113 | 11.26 | 153 | 6.38 | 193 | 4.01 |
| 34 | 19.65 | 74 | 16.01 | 114 | 11.13 | 154 | 6.30 | 194 | 3.97 |
| 35 | 19.58 | 75 | 15.90 | 115 | 10.99 | 155 | 6.22 | 195 | 3.93 |
| 36 | 19.50 | 76 | 15.79 | 116 | 10.85 | 156 | 6.14 | 196 | 3.89 |
| 37 | 19.42 | 77 | 15.69 | 117 | 10.71 | 157 | 6.06 | 197 | 3.85 |
| 38 | 19.35 | 78 | 15.58 | 118 | 10.57 | 158 | 5.98 | 198 | 3.81 |
| 39 | 19.27 | 79 | 15.47 | 119 | 10.43 | 159 | 5.91 | 199 | 3.77 |
| 40 | 19.19 | 80 | 15.36 | 120 | 10.28 | 160 | 5.83 | 200 | 3.73 |

As the actual length, 1, and the radius of gyration, r, of the leg have not changed, it is clear that the K value of the leg changes by use of the present braces. Here, that change results in effectively reducing the K value from 2 to 1, as illustrated by a comparison of the K values in row 114 of FIG. 19 with respect to conditions 112 and 110 versus condition 108. Further, use of the present braces may reduce or even eliminate the bending moments on legs that result from environmental forces such as wind, waves, and currents. The forces resulting from these bending moments may account for as much as ⅓ of the total stress on the legs of conventional vessels.

Figure 28A:
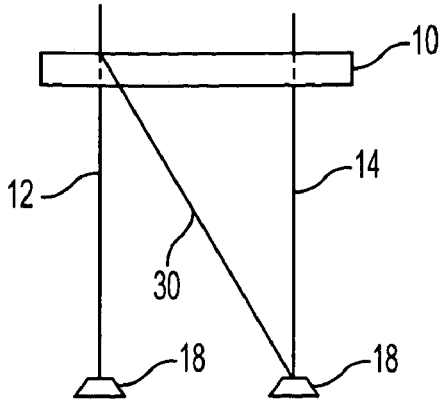
FIGS. 28A-D illustrate the effect of side-sway buckling on vessels whose legs possess, and lack, grip.
Figure 28B:
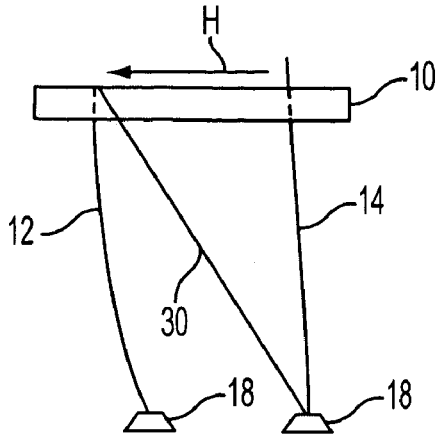
Figure 28C:
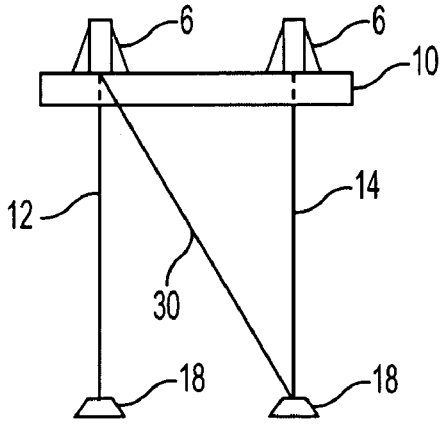
Figure 28D:
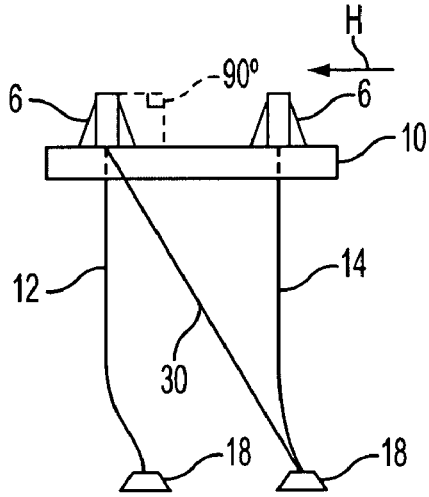

Turning back briefly to the issue of grip, each of the present holding racks promote grip between the leg tower for a leg and the leg itself. The grip on a given leg is represented by condition 120 in FIG. 19. Structural engineers refer to grip as "fixed end support" versus the "simple support" represented by condition 122. As shown in FIG. 19, by having at least some grip (i.e., one condition 120 between the ends of a given leg), one may enjoy the advantage of a theoretical K value of 0.7 or a recommended design value of 0.8 when ideal conditions are approximated as shown by condition 104 versus a K value of 1.0 illustrated by condition 108. As a result, a leg is less likely to buckle if one end is fixed, or gripped, because $$\frac{l}{r}$$

is reduced, thus making the leg more resistant to stress. The tendency of legs to suffer from side-sway buckling when grip is or is not present is illustrated in FIGS. 28A-D. FIG. 28A illustrates one of the present vessels, having brace 30 coupled to second leg 14, that does not have any leg towers or holding racks that impart grip. FIG. 28B illustrates the side-sway buckling that may result to the embodiment depicted in FIG. 28A when horizontal force H acts. By contrast, FIG. 28C illustrates the vessel depicted in FIG. 28A with leg towers that have one or more of the present holding racks (not shown) such that grip exists on each leg. As a result of the grip afforded by such leg towers, when horizontal force H acts as indicated in FIG. 28D, the angle between the leg and platform remains the same or substantially the same (90 degrees as illustrated in FIG. 28D), and the side-sway buckling is less severe than it is in FIG. 28B. Furthermore, in the situation depicted in FIG. 28B, brace 30 absorbs all of the load transmitted by H. By contrast, that same load is shared between brace 30 and the legs of the vessel in FIG. 28D. When the vessel depicted in FIG. 28D is provided with three legs and two of the present braces, the two braces would take about 75 percent of the load, and the three legs would share the other 25 percent.

Use of the present braces can reduce the total stress resulting from static and dynamic loads on conventional legs by as much as about 50%. Considering that the legs account for about 40% of the total weight of the vessel, this and comparable stress reductions may increase the carrying capacity of the present vessels by possibly up to 100% by allowing for the weight of the legs to be reduced (i.e., legs that will not bear as much stress may be smaller and lighter). Furthermore, the platforms of the present vessels may be narrower and lighter than conventional platforms because the legs may be smaller, and the platform no longer needs to be as big to stabilize the vessels as the otherwise large, heavy legs are elevated above the platform during transit.

The following description may be useful as a quick reference guide to those skilled in the art regarding the manner in which the present braces may be arranged in accordance with the present systems. The figures discussed below depict the present braces and legs of the present vessels in line format.

Figure 21A:
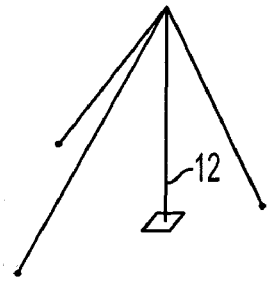
FIGS. 21A-F depict different embodiments of the present systems in which simple lines are used to represent the present braces.
Figure 21B:
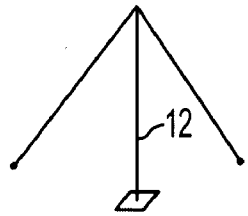
Figure 21C:
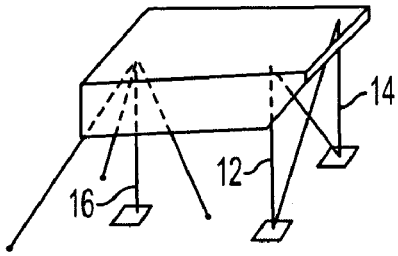
Figure 21D:
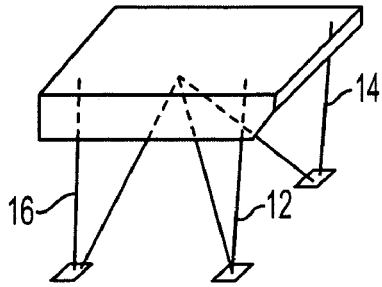
Figure 21E:
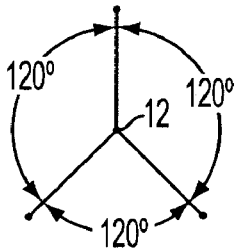
Figure 21F:
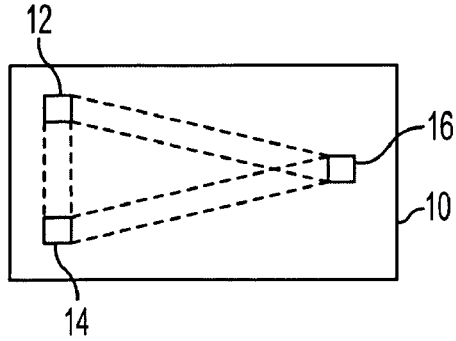

For example, FIG. 21A illustrates how three braces may be coupled to first leg 12, which braces may be flexible or rigid. FIG. 21B illustrates how two braces may coupled to first leg 12, which braces should be rigid. If, in FIG. 21B, flexible braces are utilized, any displacement or bending of first leg 12 would likely cause the tension in the braces to be lost. FIG. 21C illustrates how three braces may be coupled to third leg 16, and how a brace may be coupled to each of first and second legs 12 and 14. The anchoring structures to which each of the three braces coupled to third leg 16 in FIG. 21C may be coupled may be a footing structure (or portions thereof) coupled to third leg 16, which footing structure is not depicted. Additionally, any structure that is firmly secured to the floor beneath the body of water in which the vessel is located may serve as an anchoring structure to which the three braces coupled to third leg 16 in FIG. 21C may be coupled. FIG. 21D illustrates a brace coupled to each of the legs depicted, each brace being coupled to the same anchoring structure. FIG. 21E illustrates a top view of first leg 12 having braces as arranged in FIG. 21A. It will be understood by those skilled in the art having the benefit of this disclosure that when flexible braces are utilized in the fashion depicted in FIGS. 21A and 21E, it will be useful, but not necessary, to arrange the braces in 120 degree increments to ensure that at least one brace will be in tension should first leg 12 bend or otherwise be displaced. FIG. 21F is a top view of platform 10 to which first, second, and third legs 12, 14, and 16, respectively, are coupled. In addition, FIG. 21F depicts how two braces may extend between each pair of legs such that a total of 6 braces are utilized in stabilizing the vessel.

Figure 22A:
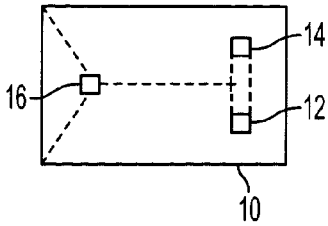
FIGS. 22A-B depict top and front views, respectively, of one embodiment of the present vessels.
Figure 23A:
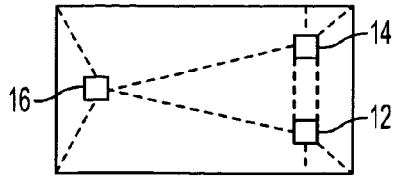
FIGS. 23A-B depict top and front views, respectively, of another embodiment of the present vessels.
Figure 22B:
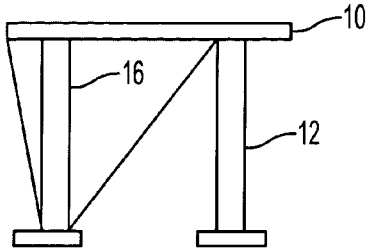
Figure 23B:
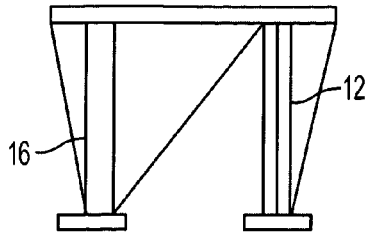
Figure 24A:
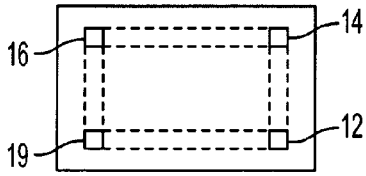
FIGS. 24A-B depict top and front views, respectively, of yet another embodiment of the present vessels.
Figure 24B:
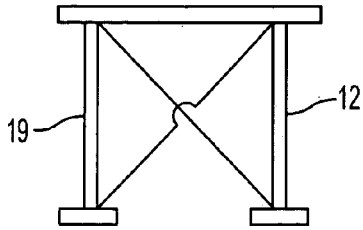

FIGS. 22A and B are top and front views, respectively, of a vessel having a platform 10 that is coupled to first, second, and third legs 12, 14, and 16, respectively. As shown, three braces are coupled to third leg 16 and two braces are coupled to both first and second legs 12 and 14. More specifically, the same two braces are coupled to both first leg 12 and to second leg 14. Like FIGS. 22A and B, FIGS. 23A and B are top and front views, respectively, of a vessel having a platform 10 that is coupled to first, second, and third legs 12, 14, and 16, respectively. As shown, four braces are coupled to third leg 16 and five braces are coupled to both first and second legs 12 and 14; two of the same braces are coupled to both first and second legs 12 and 14. FIGS. 24A and B are top and front views, respectively, of a vessel having a platform 10 that is coupled to first, second, third, and fourth legs 12, 14, 16, and 19, respectively. As shown, four braces are coupled to each of the legs. More specifically, the same two braces are coupled to both first leg 12 and second leg 14; the same two braces are coupled to both second leg 14 and third leg 16; the same two braces are coupled to both third leg 16 and fourth leg 19; and the same two braces are coupled to both fourth leg 19 and first leg 12.

In addition to the systems described above, the present invention may be described in terms of various methods useful in stabilizing vessels. One embodiment of this method may be described with reference to FIG. 2. As shown in FIG. 2, an operator may couple brace 30 to second leg 14, orient brace 30 at an acute angle 34 with second leg 14, and position at least a portion P1 of brace 30 (which is also a portion of first brace length L1 described above) beneath platform 10. The operator may couple brace 30 to second leg 14 through footing structure 18, which is located between brace 30 and second leg 14. Brace 30 may also be coupled to an anchoring structure by the operator, which anchoring structure may be platform 10. Further, brace 30 may be coupled to platform 10 through a winch (not shown) located between platform 10 and brace 30. Although shown not in FIG. 2, in light of the present disclosure, it will be understood to those skilled in the art that one or more racks may be secured to first leg 12, the anchoring structure to which brace 30 is coupled may include a ring that is coupled to platform 10, and such a ring may have a holding rack that is configured to engage the one or more racks secured to first leg 12. Accordingly, the coupling of brace 30 to the anchoring structure may include coupling brace 30 to such a ring.

Continuing with another embodiment of the present methods, when lowering or raising platform 10, first brace length L1 may be varied. Specifically, one can increase first brace length L1 while raising platform 10. For example, excess brace 30 material that is connected a wildcat may be let out as the wildcat is properly actuated to increase first brace length L1. Similarly, one can decrease first brace length L1 while lowering platform 10. For example, as platform 10 is lowered and excess brace 30 material is generated, that excess brace 30 material may be fed into a storage unit of some kind, such as a chain locker, while utilizing the potential energy of platform 10. It will be appreciated by those skilled in the art having the benefit of this disclosure that steps may be taken to ensure that brace 30 remains as taut (i.e., in tension) as is reasonable under the circumstances while increasing or decreasing first brace length L1. Moreover, during either the raising or lowering of platform 10, care should be taken to maintain tension in the brace or braces in question. As used herein, to "maintain" tension in a brace means to minimize the slackness in the brace within the tolerances allowed by the material of the brace and the materials to which the brace is coupled. One way of achieving the requisite tension involves synchronizing the hydraulic motor or motors used for actuating the pinions and the hydraulic motors for driving winches to which the braces may be coupled (referred to herein as winch motors) so as to maintain the requisite tension. Such maintenance occurs in part due to the realization of constant torque on a given winch that may be used. As used herein, two or more motors are "synchronized" if tension is maintained in the present braces being used. The standard circuit depicted in FIG. 27 may be utilized in this regard.

Figure 27:
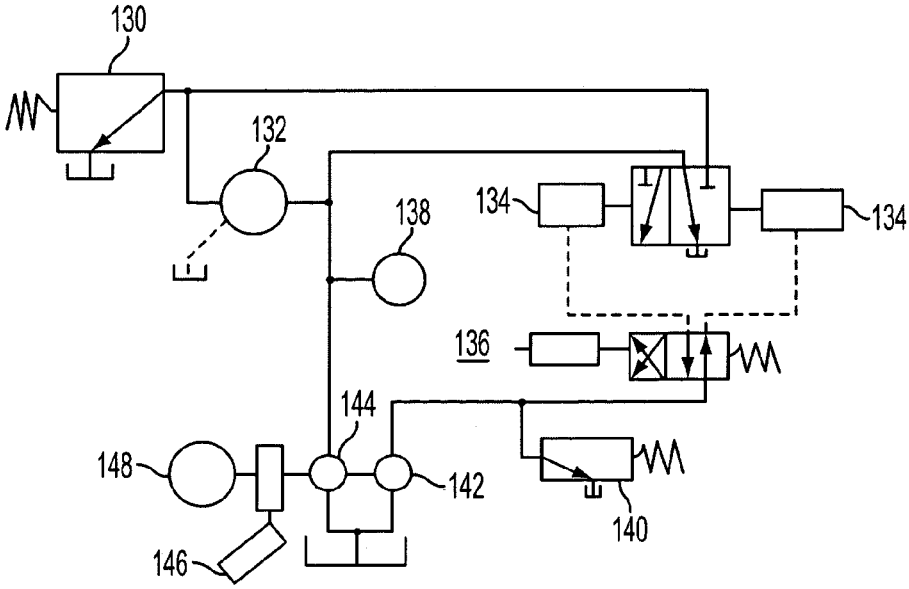
FIG. 27 depicts a circuit useful for enabling a constant torque to be applied using a fixed volume motor.

Specifically, FIG. 27 depicts a fixed volume motor 132 coupled to a number of elements as shown, which elements include a brake valve 130, a pressure switch 138, two hydraulic pressure controls 134, a solenoid valve 136, a low pressure relief 140, a fixed volume pump 142, a variable volume pump 144, a control 146, and an electric motor 148. By driving fixed volume motor 132 at constant pressure, a constant torque drive is produced. Using variable volume pump 144 to vary flow, the horsepower output of the motor varies with speed. If the load on the motor becomes excessive, the pressure rises to actuate pressure switch 138 thereby de-energizing solenoid valve 136; variable volume pump 144 unloads, and the motor stops.

Depending on weather conditions, the margin of strength available in the legs, and the extent of time required for the process, the degree to which a particular brace may be maintained taut may be relaxed. Moreover, in calm weather, for example, platform 10 may be raised or lowered without the use of the present braces provided the legs of the vessel in question possess adequate strength. Later, after the platform is in place, and the legs have been preloaded as required by the job (those skilled in the art will appreciate that preloading may involve ensuring that the legs are firmly planted on the floor by temporarily increasing the weight of the platform), the present braces may be coupled to appropriate anchoring structures, such as braces or chain stoppers, without utilizing the driving power of a wildcat.

The braces that may be used with the foregoing methods may be rigid or flexible. If brace 30 is flexible, it may be tightened when it becomes slack. Further, regardless of whether brace 30 is rigid or flexible, the uprightness of first and second legs 12 and 14 depicted in FIG. 2 (and the same is true for any of the legs disclosed herein that are part of vessels having one or more legs to which one or more of the present braces have been coupled) may be monitored. That is, deflection of the legs may be monitored. This monitoring may be accomplished, in whole or in part, using wire that is coupled at one end to the footing structure coupled to a leg, and is coupled to the platform at the other end. Multiple wires may be used. Further, any suitable electronic or sonic device suitable for detecting the deflection of a leg may also be used. Should a leg shift horizontally from its original position in a body of water, it may be lifted in order (but not necessarily to accomplish) to restore its original position within the body of water.

In accordance with the present methods, multiple braces may be coupled to legs and anchoring structures consistent with the manner just described for brace 30 depicted in FIG. 2. Furthermore, additional legs may be coupled to platform 10 illustrated in FIG. 2, and one or more braces may be coupled thereto consistent with the manner just described for brace 30.

Figure 32:
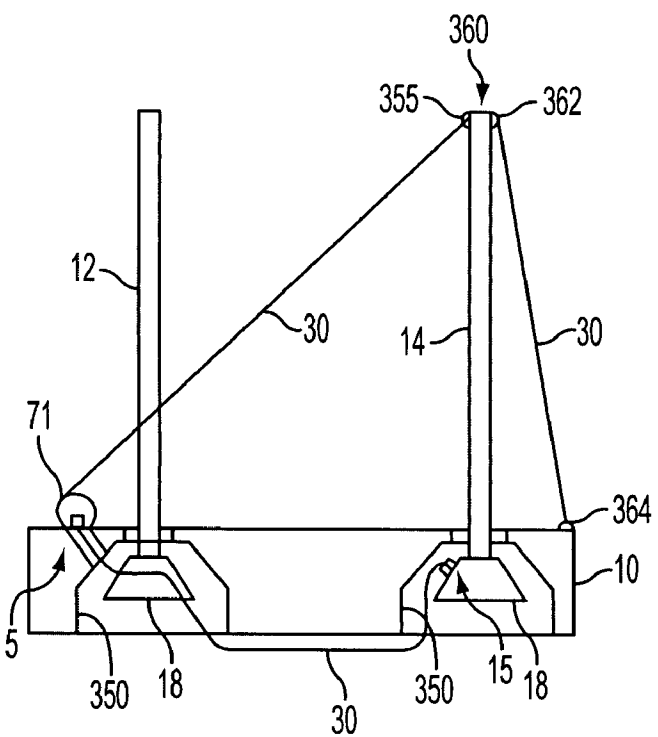
FIG. 32 illustrates the use of the present braces to stabilize a leg that is raised.
Figure 31:
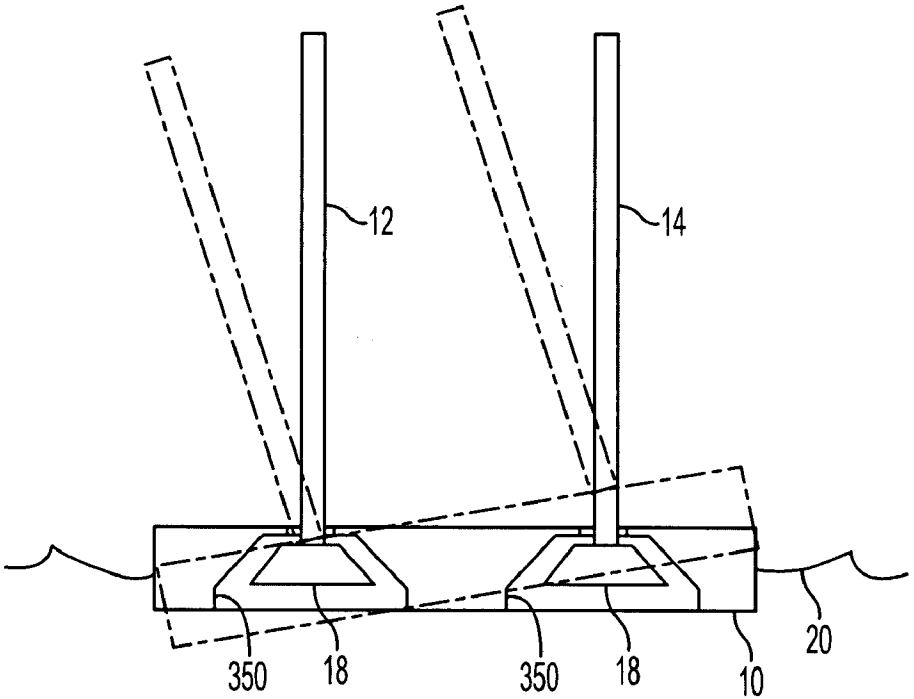
FIG. 31 illustrates a vessel undergoing rolling due, for example, to high winds and waves.

The present braces may also be useful in preventing damage to the legs of vessels while the legs are raised and the vessel is floating or in transit. As shown in FIGS. 31 and 32, first and second legs 12 and 14 (along with any other legs coupled to the platform) may be raised such that footing structures 18 are positioned with footing structures recesses 350 provided within platform 10. As shown in FIG. 31, the vessel may roll (see dashed lines) due, for example, to high winds and waves from water 20. As used herein, "roll" with respect to the motion of a vessel means side-to-side movement. In addition, under such conditions, vessels may pitch as much as ten degrees. As used herein, "pitch" with respect to the motion of a vessel means bow-to-stem, or front-to-back, movement. Such pitching and/or rolling may damage the legs of a vessel.

Accordingly, the present braces may be used to prevent or at least diminish the potential for such damage. As shown in FIG. 32, brace 30, which is coupled to second leg 14 (and specifically to the footing structure coupled to the lower end of second leg 14) at first location 15 along brace 30, and which is attached to an anchoring structure at second location 5 along brace 30 (which anchoring structure is depicted as winch 71), may be coupled to second leg 14 at third location 355, which is positioned at or near the upper end 360 of second leg 14. This configuration may be described as brace 30 being coupled to the upper end of second leg 14. As shown in FIG. 32, a second brace 30 may be coupled to both second leg 14 and an anchoring structure, which anchoring structure may, as shown, include platform 10. Specifically, second brace 30 may be coupled to second leg 14 at a first location 362 along second brace 30, which location is positioned at or near upper end 360 of second leg 14. The locations at or near the upper end of the second leg to which both braces are coupled may be the same location, in that both braces may be coupled to the same pad eye, for example. As shown in FIG. 32, second brace 30 may also be coupled to an anchoring structure at second location 364 along second brace 30.

As an alternative to the embodiment shown in FIG. 32, brace 30 that is coupled to second leg 14 at first location 15 along brace 30 and third location 355 along brace 30 may also be coupled to an anchoring structure at location 364 along brace 30 if that brace possesses enough length. In such an embodiment, second brace 30 need not be used. As yet another alternative, brace 30 need not be used at all, and another one of the present braces may be coupled to an anchoring structure at second location 5 (which anchoring structure is depicted as winch 71) along the brace and to second leg 14 at third location 355 along the brace. In addition, yet another one of the present braces may be used as illustrated by second brace 30 in FIG. 32. Thus, the present braces may be used in a system useful in stabilizing a vessel such that only one brace extends from the lower end of a leg, to an anchoring structure, to the upper end of the same leg, and to another anchoring structure; two braces may be used in this fashion; or three braces may be used in this fashion. The brace or braces may be coupled as described above prior to raising the leg. Additionally, while the brace or braces used should be taut (i.e., tension should be maintained in them) when the leg is fully raised, it will be understood by those having skill in the art that the brace or braces positioned above the platform may be slack prior the leg being fully raised. Of course, tension (or compression in the case of a rigid brace) in the brace coupled to the lower end of a leg and an anchoring structure should be maintained prior to the leg in question being fully raised.

Braces may be coupled as just described to any leg coupled to a platform in order to stabilize the leg when it is raised and the vessel is floating or in transit.

While the present disclosure may be adaptable to various modifications and alternative forms, specific embodiments have been shown by way of example and described herein. However, it should be understood that the present disclosure is not intended to be limited to the particular forms disclosed. Rather, it is to cover all modifications, equivalents, and alternatives falling within the spirit and scope of the disclosure as defined by the appended claims.

Moreover, the different aspects of the disclosed systems, vessels, and methods may be utilized in various combinations and/or independently. Thus, the invention is not limited to only those combinations shown herein, but rather may include other combinations. Those of skill in the art will understand that numerous other modifications may be made to the disclosed systems, vessels, and methods, but all such similar substitutes and modifications are deemed to be within the spirit, scope and concept of the invention.

I claim:

1. A system useful in stabilizing a vessel, the vessel including a first leg, a second leg, a third leg, and a platform coupled to the first, second, and third legs such that the platform may be raised or lowered along the first, second and third legs using pinions driven by one or more motors, the system comprising:

a first brace coupled to the first leg at a first location along the first brace, the first brace forming an acute angle with the first leg; and the first brace being coupled at a second location along the first brace to a winch driven by a winch motor capable of tensioning the first brace, the first and second locations along the first brace defining a first brace length between them;

wherein at least a portion of the first brace length is located directly beneath the platform, and the winch motor is synchronized with the one or more motors such that tension in the first brace is maintained with the winch while raising or lowering the platform.

2. The system of claim 1, wherein the first brace is coupled to the first leg through a first footing structure located between the first brace and the first leg, the first footing structure being coupled to one end of the first leg.

3. The system of claim 2, wherein the first leg has at least one opening near the end to which the footing structure is coupled, and further comprising a pin having an axis, the pin positioned within the opening such that the first leg may rotate about the axis.

4. The system of claim 2, wherein the first footing structure includes one or more protrusions defining space into which material from a floor beneath a body of water collects when the footing structure contacts the floor.

5. The system of claim 1, wherein the first brace comprises multiple loops that are linked together or wire rope.

6. The system of claim 1, further comprising:

a second brace coupled to the first leg at a first location along the second brace, the second brace forming an acute angle with the first leg; and an anchoring structure coupled to the second brace at a second location along the second brace, the first and second locations along the second brace defining a second brace length between them;

wherein at least a portion of the second brace length is located directly beneath the platform.

7. The system of claim 6, further comprising:

a third brace coupled to the first leg at a first location along the third brace, the third brace forming an acute angle with the first leg; and an anchoring structure coupled to the third brace at a second location along the third brace, the first and second locations along the third brace defining a third brace length between them;

wherein at least a portion of the third brace length is located directly beneath the platform.

8. The system of claim 7, wherein the anchoring structures coupled to the second and third braces are the same anchoring structure.

9. The system of claim 1, further comprising:

a second brace coupled to the second leg at a first location along the second brace, the second brace forming an acute angle with the second leg; and an anchoring structure coupled to the second brace at a second location along the second brace, the first and second locations along the second brace defining a second brace length between them;

wherein at least a portion of the second brace length is located directly beneath the platform.

10. The system of claim 9, wherein the second brace is coupled to the second leg through a second footing structure located between the second brace and the second leg, the second footing structure being coupled to one end of the second leg.

11. The system of claim 9, further comprising:

a third brace coupled to the second leg at a first location along the third brace, the third brace forming an acute angle with the second leg; and an anchoring structure coupled to the third brace at a second location along the third brace, the first and second locations along the third brace defining a third brace length between them;

wherein at least a portion of the third brace length is located directly beneath the platform.

12. The system of claim 11, wherein the anchoring structures coupled to the second and third braces are the same anchoring structure.

13. The system of claim 9, further comprising:

a third brace coupled to the third leg at a first location along the third brace, the third brace forming an acute angle with the third leg; and an anchoring structure coupled to the third brace at a second location along the third brace, the first and second locations along the third brace defining a third brace length between them;

wherein at least a portion of the third brace length is located directly beneath the platform.

14. The system of claim 13, wherein the third brace is coupled to the third leg through a third footing structure located between the third brace and the third leg, the third footing structure being coupled to one end of the third leg.

15. A method useful in stabilizing a vessel, the vessel having a platform and three or more legs coupled to the platform such that platform may be raised or lowered along the legs using pinions driven by one or more motors, the method comprising:

coupling a first brace to one of the legs;

orienting the first brace at an acute angle with the leg to which it is coupled;

positioning at least a portion of the first brace directly beneath the platform;

coupling the first brace to a winch driven by a winch motor; and synchronizing the winch motor with the one or more motors such that tension in the first brace is maintained at the winch while raising or lowering the platform.

16. The method of claim 15, wherein the coupling a first brace to one of the legs includes coupling the first brace to one of the legs through a footing structure located between the first brace and the one leg.

17. The method of claim 15, further comprising:

coupling a second brace to one of the other two legs;

orienting the second brace at an acute angle with the leg to which it is coupled; and positioning at least a portion of the second brace directly beneath the platform.

18. The method of claim 17, further comprising:

coupling a third brace to the third leg;

orienting the third brace at an acute angle with the third; and positioning at least a portion of the third brace directly beneath the platform.

* * * * *